US009527310B2

(12) United States Patent
Iijima

(10) Patent No.: US 9,527,310 B2
(45) Date of Patent: Dec. 27, 2016

(54) INKJET PRINTING METHOD

(71) Applicant: Konica Minolta, Inc., Tokyo (JP)

(72) Inventor: Hirotaka Iijima, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/381,486

(22) PCT Filed: Mar. 1, 2013

(86) PCT No.: PCT/JP2013/001281

§ 371 (c)(1),
(2) Date: Aug. 27, 2014

(87) PCT Pub. No.: WO2013/128945

PCT Pub. Date: Sep. 6, 2013

(65) Prior Publication Data

US 2015/0097903 A1 Apr. 9, 2015

(30) Foreign Application Priority Data

Mar. 1, 2012 (JP) ..... 2012-045488

(51) Int. Cl.
*B41J 11/00* (2006.01)
*B41J 2/14* (2006.01)
(Continued)

(52) U.S. Cl.
CPC ..... *B41J 11/002* (2013.01); *B41J 2/14201* (2013.01); *B41J 2/175* (2013.01); *B41J 2202/12* (2013.01); *B41M 7/0081* (2013.01)

(58) Field of Classification Search
CPC ..... B41J 2/04563; B41J 2/0458; B41J 2/175; B41J 2/05; B41J 2002/16564; B41J 2/355; B41J 1/0021; B41J 2002/16; B41J 2/17593; B41J 2/17513; C09D 11/34
See application file for complete search history.

(56) References Cited

U.S. PATENT DOCUMENTS 8,336,999 B2 * 12/2012 Matsumoto ..... B41J 2/17509 347/85
2003/0067517 A1 * 4/2003 Iri ..... B41J 2/1623 347/85
(Continued)

FOREIGN PATENT DOCUMENTS

CN 102001226 A 4/2011
JP 01-297251 11/1989
(Continued)

OTHER PUBLICATIONS

The Extended European Search Report dated Sep. 22, 2015 issued from the corresponding European Patent Application No. 13754669.3.
(Continued)

*Primary Examiner* — Stephen Meier
*Assistant Examiner* — Renee I Wilson
(74) *Attorney, Agent, or Firm* — Lucas & Mercanti, LLP

(57) ABSTRACT

An inkjet printing method comprises: an inkjet printing device having an inkjet print head with a built-in heater, an ink tank with a built-in heater the tank interior of which communicates with the atmosphere, and an ink supply path that connects the inkjet print head with the ink tank; a process of heating a radiation-curable inkjet ink in the ink tank with a viscosity at 25° C. of $1.0\times10^3$-$1.0\times10^6$ mPa·s to A° C.; a process of supplying the inkjet ink to the inkjet print head; a process of making the inkjet ink in the inkjet print head to be a temperature B° C. in the range of 70° C. to 120° C. and ejecting to the printing medium; and a processing of
(Continued)

irradiating radiation on the printing medium. A° C. is a temperature 5-30° C. higher than B° C.

13 Claims, 2 Drawing Sheets

(51) Int. Cl.
*B41J 2/175* (2006.01)
*B41M 7/00* (2006.01)

(56) References Cited

U.S. PATENT DOCUMENTS

| | | | | |
|---|---|---|---|---|
| 2003/0128264 | A1 | 7/2003 | Ishikawa et al. | |
| 2006/0159850 | A1 | 7/2006 | Breton et al. | |
| 2008/0036822 | A1 | 2/2008 | Oya | |
| 2009/0246403 | A1 | 10/2009 | Wetjens et al. | |
| 2011/0050793 | A1* | 3/2011 | Kumagai et al. | 347/22 |
| 2011/0050794 | A1* | 3/2011 | Koike | B41J 2/175 347/22 |
| 2011/0141187 | A1* | 6/2011 | Takabayashi | 347/20 |
| 2013/0141505 | A1* | 6/2013 | Ikeda et al. | 347/104 |
| 2013/0286120 | A1* | 10/2013 | Kobayashi | B41J 11/002 347/102 |

FOREIGN PATENT DOCUMENTS

| | | | |
|---|---|---|---|
| JP | 2003-105239 | A | 4/2003 |
| JP | 2005-053048 | A | 3/2005 |
| JP | 2006-193745 | A | 7/2006 |
| JP | 2007-152873 | A | 6/2007 |
| JP | 2008-044212 | A | 2/2008 |
| JP | 2009-510184 | A | 3/2009 |
| JP | 2010-240948 | A | 10/2010 |
| JP | 2011-051172 | A | 3/2011 |
| JP | 2011-121297 | A | 6/2011 |
| WO | 2012023368 | A1 | 2/2012 |

OTHER PUBLICATIONS

Chinese Patent Application; Application or Patent No. 201380011973.9; Issuance No. 2015120301621220; Applicant or Patentee: Konica Minolta, Inc. Title of the Invention: Inkjet Printing Method al; total of 16 pages.

English translation of Chinese Patent Application; total of 6 pages.

* cited by examiner

INKJET PRINTING METHOD

CROSS REFERENCE TO RELATED APPLICATION

This Application is a 371 of PCT/JP2013/001281 filed on Mar. 1, 2013 which, in turn, claimed the priority of Japanese Patent Application No. JP2012-045488 filed on Mar. 1, 2012 both applications are incorporated herein by reference.

TECHNICAL FIELD

The present invention relates to an inkjet recording method.

BACKGROUND ART

Active ray-curable compositions that are cured by active energy radiation such as ultraviolet radiation or an electron beam, has been conventionally put to practical use in various applications such as coating materials for plastics, paper, wood and inorganic materials; adhesives, printing ink, printed circuit boards, and electric insulation connection.

Examples of inkjet ink systems using these polymerizable compositions include an ultraviolet-curable inkjet ink that is cured by ultraviolet radiation. The inkjet method that uses this ultraviolet-curable ink has attracted public attention in recent years, from the viewpoints of quick drying properties, and the ability to perform recording on a recording medium which lacks ink absorbability.

However, an image forming method utilizing these ultraviolet-curable inkjet systems has a problem that coalescence of adjoining dots, which causes a problem at the time of high speed recording (for example, in the case of a line recording method, a recording material conveyance speed of 30 m/s or more; and in the case of a serial recording method, a printing speed of 50 $m^2$/hr or more) cannot be suppressed, and the image quality is deteriorated.

Furthermore, a hot melt ink system that uses a compound that undergoes phase change, such as wax, in the ink in an amount of 20% or more, is also attracting public attention from the viewpoint of enabling recording on ordinary paper that has not been subjected to special treatments, or on a recording medium that lacks ink absorbability. However, there is a problem that the film surface after image formation is easily peeled off with fingernails or the like.

There are known radiation-curable inks using a gelling agent, which are intended to solve these problems (see PTL 1 and PTL 2).

On the other hand, as a method of discharging air bubbles incorporated into an inkjet recording head at the time of the initial introduction of ink or at the time of head cleaning, it is known to provide a bubble discharge mechanism independently of ink droplet ejection (see PTL 3). Furthermore, as a method of preventing omitted injection or crooked flight that occurs at the time of continuous injection, there has been disclosed a technology of operating an actuator to transform the ink chamber partition walls, in such a manner that a predetermined rest time is provided between an extension pulse that extends the volume of the ink chamber by a contraction pulse that contracts the volume of the ink chamber (see PTL 4).

CITATION LIST

Patent Literature

PTL 1
Japanese Patent Application Laid-Open No. 2006-193745
PTL 2
Japanese Translation of a PCT Application Laid-Open No. 2009-510184

PTL 3
Japanese Patent Application Laid-Open No. 2008-044212
PTL 4
Japanese Patent Application Laid-Open No. 2007-152873

SUMMARY OF INVENTION

Technical Problem

However, there has been a problem that air bubble dischargeability from the inkjet recording head or continuous injection stability cannot be secured simply by printing and recording an ultraviolet-curable inkjet ink (particularly, an inkjet ink containing a gelling agent) using a conventional inkjet recording apparatus or recording method as described above. Since an inkjet ink containing a gelling agent has a high viscosity, there is a problem that any gas absorbed into the inkjet ink is not easily discharged out of the ink chamber.

It is an object of the present invention to reduce, in the case of recording with an active ray-curable inkjet ink, particularly with an active ray-curable inkjet ink containing a gelling agent, the influence exerted on injection by the gas incorporated into the inkjet ink at the time of initial introduction of the ink, or by the gas infiltrating into the ink chamber of an inkjet recording head at the time of head cleaning. Another object is to provide a highly reliable inkjet recording method by preventing omitted injection or crooked flight at the time of continuous injection.

Solution to Problem

The present invention relates to the following inkjet recording method.

[1] An inkjet recording method including a step of ejecting an active ray-curable inkjet ink having an ink viscosity at 25° C. of $1.0\times10^3$ mPa·s to $1.0\times10^6$ mPa·s using an inkjet recording apparatus which includes:

an inkjet recording head having a built-in heater;

an ink tank having a built-in heater, the interior of the tank being in communication with air; and an ink supply channel that communicates between the inkjet recording head and the ink tank, the method including:

a step of heating the active ray-curable inkjet ink in the ink tank to A° C.; a step of supplying the active ray-curable inkjet ink that has been heated to A° C., to the inkjet recording head through the ink supply channel;

a step of adjusting the active ray-curable inkjet ink that has been supplied to the inkjet recording head, to temperature B° C. in the range of 70° C. or higher but lower than 120° C., and ejecting the ink to a recording medium; and a step of irradiating the active ray-curable inkjet ink that is ejected to the recording medium, with active radiation, wherein A° C. is a temperature higher by 5° C. to 30° C. than B° C.

[2] The inkjet recording method described in item [1], in which the active ray-curable inkjet ink contains a gelling agent.

[3] The inkjet recording method described in item [1] or [2], in which the sol-gel phase transition temperature in the active ray-curable inkjet ink is 25° C. or higher.

[4] The inkjet recording method described in any one of items [1] to [3], further including a step of discharging the active ray-curable inkjet ink in the inkjet recording head to the ink tank.

[5] The inkjet recording method described in any one of items [1] to [4], further including a step of stirring the active ray-curable inkjet ink in the ink tank.

Advantageous Effects of Invention

According to the inkjet recording method of the present invention, in the case of recording with an active ray-curable inkjet ink, particularly with an active ray-curable inkjet ink containing a gelling agent, the influence exerted on injection by the gas incorporated into the inkjet ink at the time of initial introduction of the ink or the gas infiltrating into the ink chamber of an inkjet recording head at the time of head cleaning, is reduced. Furthermore, a highly reliable inkjet recording method can be provided by preventing omitted injection or crooked flight at the time of continuous injection.

DESCRIPTION OF EMBODIMENTS

Figure 1:
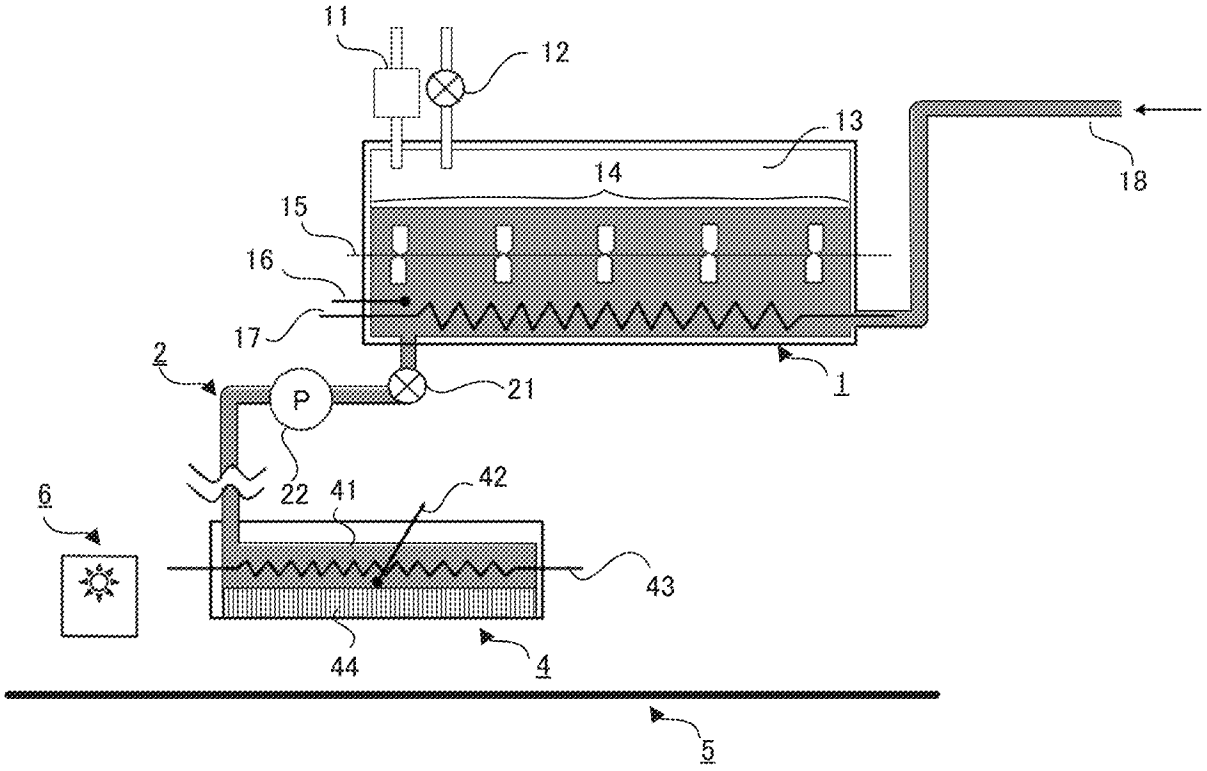
FIG. 1 is a diagram illustrating an example of the configuration of the essential part of an inkjet recording apparatus which does not have a discharge channel.

Hereinafter, the present invention will be described by way of embodiments, but the present invention is not intended to be limited to the following embodiments.

1. Regarding Active Ray-Curable Inkjet Ink

It is preferable that the active ray-curable inkjet ink usually contain a coloring material, an active ray-curable monomer and a photopolymerization initiator, and further contains a gelling agent.

<Regarding Polymerization Mode>

The inkjet ink used in the present embodiment may utilize any polymerization mode, but a cationic polymerization mode or a radical polymerization mode is preferred.

<Regarding Active Ray Curable Monomer>

Examples of active radiation include an electron beam, ultraviolet radiation, α-radiation, γ-radiation, and X-radiation; among which, ultraviolet radiation or an electron beam is preferred from the viewpoint of hazardousness to the human body, easy handleability, and widespread industrial utilization. In the present embodiment, ultraviolet radiation is particularly preferred.

The active ray-curable monomer is a compound that undergoes crosslinking or polymerization by irradiation with active radiation. The active ray-curable monomer used in the present invention may be an oligomer or polymer having a polymerized form of the monomer as a main chain. Examples of the cationically polymerizable compound and radically polymerizable compound that are used in the cationic polymerization mode and the radical polymerization mode will be described below.

(Cationically Polymerizable Compound)

Examples of the cationically polymerizable compound include the epoxy compounds, vinyl ether compounds, and oxetane compounds exemplified in Japanese Patent Application Laid-Open No. HEI 6-9714, Japanese Patent Application Laid-Open No. 2001-31892, Japanese Patent Application Laid-Open No. 2001-40068, Japanese Patent Application Laid-Open No. 2001-55507, Japanese Patent Application Laid-Open No. 2001-310938, Japanese Patent Application Laid-Open No. 2001-310937, and Japanese Patent Application Laid-Open No. 2001-220526.

For the purpose of suppressing contraction of the recording medium at the time of ink curing, it is preferable to incorporate at least one oxetane compound and at least one compound selected from an epoxy compound and a vinyl ether compound as the active ray-curable monomers.

Examples of aromatic epoxide include a di- or polyglycidyl ether produced by a reaction between a polyvalent phenol having at least one aromatic nucleus, or an alkylene oxide adduct thereof; and epichlorohydrin. Examples thereof include di- or polyglycidyl ethers of bisphenol A or alkylene oxide adducts thereof; di- or polyglycidyl ethers of hydrogenated bisphenol A or alkylene oxide adducts thereof; and novolac type epoxy resins. Here, examples of the alkylene oxide include ethylene oxide and propylene oxide.

Examples of alicyclic epoxides include cyclohexene oxide- or cyclopentene oxide-containing compounds obtainable by epoxidizing a compound having at least one cycloalkane ring such as a cyclohexene or cyclopentene ring with an appropriate oxidizing agent such as hydrogen peroxide or peracid.

Examples of aliphatic epoxides include di- or polyglycidyl ethers of aliphatic polyhydric alcohols or alkylene oxide adducts thereof. Representative examples thereof include diglycidyl ethers of alkylene glycols, such as diglycidyl ether of ethylene glycol, diglycidyl ether of propylene glycol, and diglycidyl ether of 1,6-hexanediol; polyglycidyl ethers of polyhydric alcohols, such as di- or triglycidyl ethers of glycerin or alkylene oxide adducts thereof; and diglycidyl ethers of polyalkylene glycols, such as diglycidyl ethers of polyethylene glycol or alkylene oxide adducts thereof, and diglycidyl ethers of polypropylene glycol or alkylene oxide adducts thereof. Here, examples of the alkylene oxide include ethylene oxide and propylene oxide.

Among these epoxides, when curability is considered, an aromatic epoxide and an alicyclic epoxide are preferred, and an alicyclic epoxide is particularly preferred. The inkjet ink used in the present embodiment may contain one kind of the epoxide described above alone, but may also contain two or more kinds in appropriate combination.

Examples of the vinyl ether compound include di- or trivinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether, and trimethylolpropane trivinyl ether; and monovinyl ether compounds such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-o-propylene carbonate, dodecyl vinyl ether, diethylene glycol monovinyl ether, and octadecyl vinyl ether.

Among these vinyl ether compounds, when curability, adhesiveness and surface hardness are considered, a di- or trivinyl ether compound is preferred, and a divinyl ether compound is particularly preferred. In the present embodiment, the vinyl ether compounds described above may be used singly, or two or more kinds may be used in appropriate combination.

The oxetane compound that can be used in the present embodiment is a compound having an oxetane ring. All known oxetane compounds that are described in Japanese Patent Application Laid-Open No. 2001-220526 and Japanese Patent Application Laid-Open No. 2001-310937 can be used.

If a compound having five or more oxetane rings is incorporated, the viscosity of the inkjet ink increases, and thus handling becomes difficult. Furthermore, since the glass transition temperature of the inkjet ink rises, the adhesiveness of the cured product thus obtainable may not be sufficient. The compound having an oxetane ring that may be used in the present embodiment is preferably a compound having one to four oxetane rings.

Examples of the compound having an oxetane ring that can be preferably used in the present embodiment include the compound represented by Formula (1) described in paragraph (0089) of Japanese Patent Application Laid-Open No. 2005-255821, and the compounds represented by Formula (2) described in paragraph (0092), Formula (7) of paragraph (0107), Formula (8) of paragraph (0109), and Formula (9) of paragraph (0166) of Japanese Patent Application Laid-Open No. 2005-255821.

Specifically, Exemplary Compounds 1 to 6 described in paragraphs (0104) to (0119) and the compounds described in paragraph (0121) of Japanese Patent Application Laid-Open No. 2005-255821 are included.

(Radically Polymerizable Compound)

Examples of the radically polymerizable compound include radically polymerizable compounds described in Japanese Patent Application Laid-Open No. HEI 7-159983, Japanese Examined Patent Application Publication No. HEI 7-31399, Japanese Patent Application Laid-Open No. HEI 8-224982, and Japanese Patent Application Laid-Open No. HEI 10-863.

A radically polymerizable compound is a compound having a radically polymerizable, ethylenically unsaturated bond. The radically polymerizable compound is not limited as long as it is a compound having at least one radically polymerizable, ethylenically unsaturated bond in the molecule, and examples include compounds having chemical forms such as a monomer, an oligomer, and a polymer. The radically polymerizable compounds may be used singly, or in order to enhance the intended characteristics, two or more kinds may be used in combination at any arbitrary ratio.

Examples of the monomer having a radical polymerizable ethylenically unsaturated bond include unsaturated carboxylic acids, such as acrylic acid, methacrylic acid, itaconic acid, crotonic acid, isocrotonic acid and maleic acid, and salts or esters thereof, and a radical polymerizable compound such as urethane, amide or anhydride, acrylonitrile, styrene, further various unsaturated polyester, unsaturated polyether, unsaturated polyamide, and unsaturated urethane.

For the active ray-curable monomer used in the present embodiment, all known (meth)acrylate monomers and/or oligomers can be used. The term "and/or" as used in the present embodiment means that the monomer may be a monomer or may be an oligomer, or the monomer may include both of them. The same also applies to the matters that will be described below.

Examples of the monofunctional monomer include isoamyl acrylate, stearyl acrylate, lauryl acrylate, octyl acrylate, decyl acrylate, isomyristyl acrylate, isostearyl acrylate, 2-ethylhexyl-diglycol acrylate, 2-hydroxybutyl acrylate, 2-acryloyl hexahydrophthalic acid, butoxyethyl acrylate, ethoxydiethylene glycol acrylate, methoxy diethylene glycol acrylate, methoxy polyethylene glycol acrylate, methoxy propylene glycol acrylate, phenoxyethyl acrylate, tetrahydrofurfuryl acrylate, isobornyl acrylate, 2-hydroxyethyl acrylate, 2-hydroxypropyl acrylate, 2-hydroxyl-3-phenoxypropyl acrylate, 2-acryloyloxyethyl succinic acid, 2-acryloyloxyethyl phthalic acid, 2-acryloyloxyethyl-2-hydroxyethyl-phthalic acid, lactone modified flexible acrylate, and t-butylcyclohexyl acrylate.

Examples of the bifunctional monomer include triethylene glycol diacrylate, tetraethylene glycol diacrylate, polyethylene glycol diacrylate, tripropylene glycol diacrylate, polypropylene glycol diacrylate, 1,4-butanediol diacrylate, 1,6-hexanediol diacrylate, 1,9-nonanediol diacrylate, neopentyl glycol diacrylate, dimethylol-tricyclodecane diacrylate, diacrylate of PO adduct with bisphenol-A, hydroxyl pivalic acid neopentyl glycol diacrylate, and polytetramethylene glycol diacrylate.

Examples of the polyfunctional monomer with a functionality of 3 or more include trimethylolpropane triacrylate, pentaerythritol triacrylate, EO modified trimethylolpropane triacrylate, pentaerythritol tetraacrylate, EO modified pentaerythritol tetraacrylate, dipentaerythritol hexaacrylate, ditrimethylol propane tetraacrylate, glycerin propoxy triacrylate, caprolactone modified trimethylolpropane triacrylate, pentaerythritol ethoxy tetraacrylate, and caprolactam modified dipentaerythritol hexaacrylate.

In addition to these, polymerizable oligomers can also be incorporated as well as the monomers. Examples of a polymerizable oligomer include epoxy acrylate, aliphatic urethane acrylate, aromatic urethane acrylate, polyester acrylate, and linear acrylic oligomer. More specifically, those commercially available products described in YAMASHITA, Shinzo, ed., "Kakyozai Handobukku (Handbook of Crosslinking Agents)", (1981, Taiseisha Co., Ltd.); KATO, Kiyomi, ed., "UV•EB Koka Handobukku (UV•EB Curing Handbook) (Raw Materials Edition)" (1985, Kobunshi Kankokai); RadTech Japan, ed., "UV•EB Koka Gijutsu no Oyo to Shijo (Applications and Markets of UV•EB Curing Technologies)", p. 79 (1989, CMC Publishing Co., Ltd.; TAKIYAMA, Eiichiro, "Poliesterujyusi Handobukku (Polyester Resin Handbook)", (1988, Nikkan Kogyo Shimbun, Ltd.), or any radically polymerizable or crosslinkable monomer oligomers and polymers that are known in the art can be used.

Among them, polyethylene glycol diacrylate, EO modified trimethylolpropane triacrylate, EO modified pentaerythritol tetraacrylate, and the like are preferred.

As the radically polymerizable compound used in the present embodiment, a vinyl ether monomer and/or oligomer and a (meth)acrylate monomer and/or oligomer may be used in combination. Examples of the vinyl ether monomer include di- or trivinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether, and trimethylolpropane trivinyl ether; and monovinyl ether compounds such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-o-propylene carbonate, dodecyl vinyl ether, diethylene glycol monovinyl ether, and octadecyl vinyl ether. In the case of using a vinyl ether oligomer, a bifunctional vinyl ether compound having a molecular weight of 300 to 1000 and having 2 to 3 ester groups in the molecule is preferred, and examples thereof include, but are not limited to, compounds available as VEctomer series of Sigma-Aldrich Co., namely, VEctomer 4010, VEctomer 4020, VEctomer 4040, VEctomer 4060, and VEctomer 5015.

Various vinyl ether compounds and maleimide compounds can also be used in combination as the radically polymerizable compound used in the present embodiment. Examples of the maleimide compounds include, but are not limited to, N-methylmaleimide, N-propylmaleimide, N-hexylmaleimide, N-laurylmaleimide, N-cyclohexylmaleimide, N-phenylmaleimide, N,N'-methylenebismaleimide, polypropylene glycol-bis(3-maleimidopropyl)ether, tetraethylene glycol-bis(3-maleimidopropyl)ether, bis(2-maleimidoethyl)carbonate, N,N'-(4,4'-diphenylmethane)bismaleimide, N,N'-2,4-tolylenebismaleimide, and polyfunctional maleimide compounds which are ester compounds of the maleimide carboxylic acids disclosed in Japanese Patent Application Laid-Open No. HEI 11-124403 and various polyols.

The content of the active ray-curable monomer contained in the inkjet ink is preferably 1% to 97% by mass, and more preferably 30% to 95% by mass.

<Regarding Coloring Material>

Regarding the coloring material that constitutes the inkjet ink used in the present embodiment, a dye or a pigment can be used without limitations. Among them, it is preferable to use a pigment having favorable dispersion stability in the ink components and having excellent weather resistance. Without any particular limitations, examples of the pigment that can be used include organic or inorganic pigments having the following numbers described in the Color Index.

Red or magenta pigments such as Pigment Red 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226 and 257; Pigment Violet 3, 19, 23, 29, 30, 37, 50 and 88; and Pigment Orange 13, 16, 20 and 36;

blue or cyan pigments such as Pigment Blue 1, 15, 15:1, 15:2, 15:3, 15:4, 15:6, 16, 17-1, 22, 27, 28, 29, 36, and 60;

green pigments such as Pigment Green 7, 26, 36, and 50;

yellow pigments such as Pigment Yellow 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, and 193;

black pigments such as Pigment Black 7, 28, and 26; and the like can be used in accordance with the purpose.

Specific examples include, by trade name, CHROMOFINE YELLOW 2080, 5900, 5930, AF-1300, and 2700L; CHROMOFINE ORANGE 3700L and 6730; CHROMOFINE SCARLET 6750; CHROMOFINE MAGENTA 6880, 6886, 6891N, 6790, and 6887; CHROMOFINE VIOLET RE; CHROMOFINE RED 6820 and 6830; CHROMOFINE BLUE HS-3, 5187, 5108, 5197, 5085N, SR-5020, 5026, 5050, 4920, 4927, 4937, 4824, 4933GN-EP, 4940, 4973, 5205, 5208, 5214, 5221, and 5000P; CHROMOFINE GREEN 2GN, 2GO, 2G-550D, 5310, 5370, and 6830; CHROMOFINE BLACK A-1103; SEIKAFAST YELLOW 10GH, A-3, 2035, 2054, 2200, 2270, 2300, 2400(B), 2500, 2600, ZAY-260, 2700(B), and 2770; SEIKAFAST RED 8040, C405(F), CA120, LR-116, 1531B, 8060R, 1547, ZAW-262, 1537B, GY, 4R-4016, 3820, 3891, and ZA-215; SEIKAFAST CARMINE 6B1476T-7, 1483LT, 3840, and 3870; SEIKAFAST BORDEAUX 10B-430; SEIKALIGHT ROSE R40; SEIKALIGHT VIOLET B800 and 7805; SEIKAFAST MAROON 460N; SEIKAFAST ORANGE 900 and 2900; SEIKALIGHT BLUE C718 and A612; CYANINE BLUE 4933M, 4933GN-EP, 4940, and 4973 (manufactured by Dainichiseika Color & Chemicals Mfg. Co., Ltd.); KET Yellow 401, 402, 403, 404, 405, 406, 416, and 424; KET Orange 501; KET Red 301, 302, 303, 304, 305, 306, 307, 308, 309, 310, 336, 337, 338, and 346; KET Blue 101, 102, 103, 104, 105, 106, 111, 118, and 124; KET Green 201 (manufactured by Dainippon Ink and Chemicals, Inc.); Colortex Yellow 301, 314, 315, 316, P-624, 314, U10GN, U3GN, UNN, UA-414, and U263; Finecol Yellow T-13 and T-05; Pigment Yellow 1705; Colortex Orange 202; Colortex Red 101, 103, 115, 116, D3B, P-625, 102, H-1024, 105C, UFN, UCN, UBN, U3BN, URN, UGN, UG276, U456, U457, 105C, and USN; Colortex Maroon 601; Colortex Brown B610N; Colortex Violet 600; Pigment Red 122; Colortex Blue 516, 517, 518, 519, A818, P-908, and 510; Colortex Green 402 and 403; Colortex Black 702; U905 (manufactured by Sanyo Color Works, Ltd.); Lionol Yellow 1405G; Lionol Blue FG7330, FG7350, FG7400G, FG7405G, ES, and ESP-S (manufactured by Toyo Ink Group); Toner Magenta E02; Permanent Rubin F6B; Toner Yellow HG; Permanent Yellow GG-02; Hostapeam Blue B2G (manufactured by Hoechst AG); Novoperm P-HG; Hostaperm Pink E; Hostaperm Blue B2G (manufactured by Clariant AG); CARBON BLACK #2600, #2400, #2350, #2200, #1000, #990, #980, #970, #960, #950, #850, MCF88, #750, #650, MA600, MA7, MA8, MA11, MA100, MA100R, MA77, #52, #50, #47, #45, #45L, #40, #33, #32, #30, #25, #20, #10, #5, #44, and CF9 (manufactured by Mitsubishi Chemicals Corp.).

Dispersing of the pigment can be carried out using, for example, a ball mill, a sand mill, an attritor, a roll mill, an agitator, a Henschel mixer, a colloid mill, an ultrasonic homogenizer, a pearl mill, a wet jet mill, and a paint shaker.

When dispersing of the pigment is performed, a dispersant can also be added. As an example of the dispersant, it is preferable to use a polymeric dispersant, and examples of the polymeric dispersant include Solsperse series of Avecia, Inc., and PB series of Ajinomoto Fine-Techno Co., Inc. Further examples include compounds described below.

Examples of a pigment dispersant include hydroxyl group-containing carboxylic acid esters, salts of long-chain polyaminoamides and high molecular weight acid esters, salts of high molecular weight polycarboxylic acids, salts of long-chain polyaminoamides and polar acid esters, high molecular weight unsaturated acid esters, copolymerization products, modified polyurethane, modified polyacrylate, polyether ester type anionic active agents, naphthalenesulfonic acid-formalin condensate salts, aromatic sulfonic acid-formalin condensate salts, polyoxyethylene alkyl phosphoric acid esters, polyoxyethylene nonyl phenyl ether, stearylamine acetate, and pigment derivatives.

Specific examples of manufactured products of pigment dispersants include "Anti-Terra-U (polyaminoamide phosphate)", "Anti-Terra-203/204 (high molecular weight polycarboxylic acid salts)", "Disperbyk-101 (polyaminoamide phosphate and acid ester), 107 (hydroxyl group-containing carboxylic acid ester), 110 (copolymer containing an acid group), 130 (polyamide), 161, 162, 163, 164, 165, 166, 170 (copolymers)", "400", "Bykumen" (high molecular weight unsaturated acid ester), "BYK-P104, P105 (high molecular weight unsaturated acid polycarboxylic acids)", "P104S, 240S (high molecular weight unsaturated acid polycarboxylic acid and silicone system)", and "Lactimon (long-chain amine, unsaturated acid polycarboxylic acid, and silicone)".

Further examples include "EFKA 44, 46, 47, 48, 49, 54, 63, 64, 65, 66, 71, 701, 764 and 766", "EFKA POLYMER-100 (modified polyacrylate), 150 (aliphatic modified polymer), 400, 401, 402, 403, 450, 451, 452, 453 (modified polyacrylates), 745 (copper phthalocyanine-based)" manufactured by Efka Chemicals B.V.; "FLOWLEN TG-710 (urethane oligomer)", "FLOWNON SH-290 and SP-1000", "POLYFLOW No. 50E, No. 300 (acrylic copolymers)"

manufactured by Kyoeisha Chemical Co., Ltd.; "DISPERLON KS-860, 873SN, 874 (polymeric dispersants), #2150 (aliphatic polycarboxylic acid), and #7004 (polyether ester type)", manufactured by Kusumoto Chemicals, Ltd.

Further examples include "DEMOL RN, N (naphthalenesulfonic acid-formalin condensate sodium salt), MS, C, SN-B (aromatic sulfonic acid-formalin condensate sodium salt), and EP", "HOMOGENOL L-18 (polycarboxylic acid type polymer)", "EMULGEN 920, 930, 931, 935, 950, and 985 (polyoxyethylene nonyl phenyl ether)", "ACETAMIN 24 (coconut amine acetate), 86 (stearylamine acetate)" manufactured by Kao Corp.; "SOLSPERSE 5000 (phthalocyanine ammonium salt-based), 13240, 13940 (polyester amine-based), 17000 (fatty acid amine-based), 24000, and 32000" manufactured by Zeneca Group PLC; "NIKKOL T106 (polyoxyethylene sorbitan monooleate), MYS-IEX (polyoxyethylene monostearate), and Hexagline 4-0 (hexaglyceryl tetraoleate)" manufactured by Nikko Chemicals Co., Ltd.

These pigment dispersants are preferably incorporated in an amount in the range of 0.1% to 20% by mass in the ink. Also, regarding the dispersing aid, pigment derivatives (synergists) corresponding to various pigments can also be used. These dispersants and dispersion aids are preferably added in an amount of 1 part to 50 parts by mass relative to 100 parts by mass of the pigment. The dispersing medium is a solvent or a polymerizable compound.

According to the present embodiment, it is preferable that the inkjet ink used to be irradiated with active radiation to ink droplets that have been impacted on a recording medium and to thereby cure an image, be solventless. If solvent remains on a cured image, there occur problems of deterioration of solvent resistance and the volatile organic compound (VOC) of remaining solvent. Therefore, regarding the dispersing medium, it is preferable, in view of dispersion suitability, to select not a solvent but a polymerizable compound, among others, a monomer having the lowest viscosity.

The average particle size of the pigment is preferably 0.08 μm to 0.5 μm, and the maximum particle size of the pigment is 0.3 μm to 10 μm, and preferably 0.3 μm to 3 μm. In order to perform regulation of the average particle size of the pigment, selection of the pigment, dispersant and dispersing medium, the dispersion conditions, and the filtration conditions are appropriately set. Through this particle size management, clogging of the nozzles of a recording head can be suppressed, and storage stability of the ink, ink transparency and curing sensitivity can be maintained.

The inkjet ink used in the present embodiment may optionally use a conventionally known dye, and preferably an oil-soluble dye. Examples of the oil-soluble dye that can be used in the present embodiment include the following dyes, but are not limited to these.

(Magenta Dyes)

MS Magenta VP, MS Magenta HM-1450, MS Magenta HSo-147 (all manufactured by Mitsui Toatsu Chemicals, Inc.); AIZEN SOT Red-1, AIZEN SOT Red-2, AIZEN SOT Red-3, AIZEN SOT Pink-1, SPIRON Red GEH SPECIAL (all manufactured by Hodogaya Chemical Co., Ltd.); RESOLIN Red FB 200%, MACROLEX Red Violet R, MACROLEX ROT5B (all manufactured by Bayer Japan, Ltd.); KAYASET Red B, KAYASET Red 130, KAYASET Red 802 (all manufactured by Nippon Kayaku Co., Ltd.); PHLOXIN, ROSE BENGAL, ACID Red (all manufactured by Daiwa Chemical Industry Co., Ltd.); HSR-31, DIARESIN Red K (all manufactured by Mitsubishi Chemical Corp.); and Oil Red (manufactured by BASF Japan, Ltd.).

(Cyan Dyes)

MS Cyan HM-1238, MS Cyan HSo-16, Cyan HSo-144, MS Cyan VPG (all manufactured by Mitsui Toatsu Chemicals, Inc.); AIZEN SOT Blue-4 (all manufactured by Hodogaya Chemical Co., Ltd.); RESOLIN BR. Blue BGLN 200%, MACROLEX Blue RR, CERES Blue GN, SIRIUS SUPRATURQ. Blue Z-BGL, SIRIUS SUPRATURQ Blue FB-LL 330% (all manufactured by Bayer Japan, Ltd.); KAYASET Blue FR, KAYASET Blue N, KAYASET Blue 814, Turq. Blue GL-5 200, Light Blue BGL-5 200 (all manufactured by Nippon Kayaku Co., Ltd.); DAIWA Blue 7000, Oleosol FAST Blue GL (all manufactured by Daiwa Chemical Industry Co., Ltd.); DIARESIN Blue P (manufactured by Mitsubishi Chemical Corp.); SUDAN Blue 670, NEOPEN Blue 808, and ZAPON Blue 806 (all manufactured by BASF Japan, Ltd.).

(Yellow Dyes)

MS Yellow HSm-41, Yellow KX-7, Yellow EX-27 (all manufactured by Mitsui Toatsu Chemicals, Inc.), AIZEN SOT Yellow-1, AIZEN SOT YelloW-3, AIZEN SOT Yellow-6 (all manufactured by Hodogaya Chemical Co., Ltd.); MACROLEX Yellow 6G, MACROLEX FLUOR. Yellow 10GN (all manufactured by Bayer Japan, Ltd.); KAYASET Yellow SF-G, KAYASET Yellow 2G, KAYASET Yellow A-G, KAYASET Yellow E-G (all manufactured by Nippon Kayaku Co., Ltd.); DAIWA Yellow 330HB (manufactured by Daiwa Chemical Industry Co., Ltd.); HSY-68 (manufactured by Mitsubishi Chemical Corp.); SUDAN Yellow 146, and NEOPEN Yellow 075 (all manufactured by BASF Japan, Ltd.).

(Black Dyes)

MS Black VPC (manufactured by Mitsui Toatsu Chemicals, Inc.); AIZEN SOT Black-1, AIZEN SOT Black-5 (all manufactured by Hodogaya Chemical Co., Ltd.); RESORIN Black GSN 200%, RESOLIN Black BS (all manufactured by Bayer Japan, Ltd.); KAYASET Black A-N (manufactured by Nippon Kayaku Co., Ltd); DAIWA Black MSC (manufactured by Daiwa Chemical Industry Co., Ltd.); HSB-202 (manufactured by Mitsubishi Chemical Corp.); NEPTUNE Black X60, and NEOPEN Black X58 (all manufactured by BASF Japan, Ltd.).

The content of the pigment or the oil-soluble dye is preferably 0.1% to 20% by mass, and more preferably 0.4% to 10% by mass, relative to the total mass of the ink. When the content is 0.1% by mass or more, favorable image quality is obtained, and when the content is 20% by mass or less, an ink viscosity appropriate for ink emission is obtained. Two or more kinds of colorants can be used by suitably mixing for the purpose of color adjustment or the like.

<Photopolymerization Initiator>

In the case of using ultraviolet radiation or the like as active radiation, it is preferable that the inkjet ink used in the present embodiment contain at least one photopolymerization initiator. However, in most cases in which an electron beam is used as the active radiation, the photopolymerization initiator is not needed.

The photopolymerization initiators used for the radical polymerization mode can be roughly classified into two kinds, namely, an intramolecular bond cleavage type and an intramolecular hydrogen abstraction type.

Examples of photopolymerization initiators of the intramolecular bond cleavage type include acetophenone-based compounds such as diethoxyacetophenone, 2-hydroxy-2-methyl-1-phenylpropan-1-one, benzyl dimethyl ketal, 1-(4-isopropylphenyl)-2-hydroxy-2-methylpropan-1-one, 4-(2-hydroxyethoxyl)phenyl(2-hydroxy-2-propyl)ketone, 1-hydroxycyclohexyl phenyl ketone, 2-methyl-2-morpholino-(4-thiomethylphenyl)propan-1-one, and 2-benzyl-2-dimethylamino-1-(4-morpholinophenyl)butanone; benzoins such as benzoin, benzoin methyl ether, and benzoin isopropyl ether; acylphosphine oxide-based compounds such as 2,4,6-trimethylbenzoin diphenylphosphine oxide; benzil, and methyl phenyl glyoxy ester.

Examples of photopolymerization initiators of the intramolecular hydrogen abstraction type include benzophenone-based compounds such as benzophenone, o-benzoylbenzoic acid methyl-4-phenylbenzophenone, 4,4'-dichlorobenzophenone, hydroxybenzophenone, 4-benzoyl-4'-methyl diphenyl sulfide, acrylated benzophenone, 3,3',4,4'-tetra(t-butylperoxycarbonyl)benzophenone, and 3,3'-dimethyl-4-methoxybenzophenone; thioxanthone-based compounds such as 2-isopropylthioxanthone, 2,4-dimethylthioxanthone, 2,4-diethylthioxanthone, and 2,4-dichlorothioxanthone; aminiobenzophenone-based compounds such as Michler's ketone and 4,4'-diethylaminobenzophenone; 10-butyl-2-chloroacridone, 2-ethylanthraquinone, 9,10-phenanthrenequinone, and camphor-quinone.

Further examples of radical polymerization initiators include the triazine derivatives described in Japanese Examined Patent Application Publication No. SHO 59-1281, Examined Patent Application Publication No. SHO 61-9621, and Japanese Patent Application Laid-Open No. SHO 60-60104; the organic peroxides described in Japanese Patent Application Laid-Open No. SHO 59-1504 and Japanese Patent Application Laid-Open No. SHO 61-243807; the diazonium compounds described in Examined Patent Application Publication No. SHO 43-23684, Japanese Examined Patent Application Publication No. SHO 44-6413, Japanese Examined Patent Application Publication No. SHO 44-6413, Japanese Examined Patent Application Publication No. SHO 47-1604, and U.S. Pat. No. 3,567,453; the organic azide compounds described in U.S. Pat. No. 2,848,328, U.S. Pat. No. 2,852,379, and U.S. Pat. No. 2,940,853; the orthoquinonediazides described in Japanese Examined Patent Application Publication No. SHO 36-22062, Japanese Examined Patent Application Publication No. SHO 37-13109, Japanese Examined Patent Application Publication No. SHO 38-18015, and Japanese Examined Patent Application Publication No. SHO 45-9610; the various onium compounds described in Japanese Examined Patent Application Publication No. SHO 55-39162, Japanese Patent Application Laid-Open SHO 59-14023, and "Macromolecules, Vol. 10, p. 1307 (1977)"; the azo compounds described in Japanese Patent Application Laid-Open No. SHO 59-142205; the metal-arene complexes described in Japanese Patent Application Laid-Open No. HEI 1-54440, European Patent No. 109,851, European Patent No. 126,712, and "Journal of Imaging Science (J. Imag. Sci.), Vol. 30, p. 174 (1986)"; the (oxo)sulfonium-organoboron complexes described in Japanese Patent No. 2711491 and Japanese Patent No. 2803454; the titanocenes described in Japanese Patent Application Laid-Open No. SHO 61-151197; the transition metal complexes containing transition metals such as ruthenium, described in ("Coordination Chemistry Review", Vol. 84, pp. 85-277 (1988)) and Japanese Patent Application Laid-Open No. HEI 2-182701; the 2,4,5-triarylimidazole dimer and carbon tetrabromide described in Japanese Patent Application Laid-Open No. HEI 3-209477; and the organic halogen compounds described in Japanese Patent Application Laid-Open No. SHO 59-107344.

The content of a photopolymerization initiator, if used, is preferably in the range of 0.01% to 10% by mass relative to the mass of the active ray-curable monomer.

A photoacid generator is used for the cationic polymerization mode.

For the photoacid generator, for example, those compounds used in chemically amplified photoresists or cationic polymerization are used (see Japanese Research Association for Organic Electronics Materials, ed., "Imejingu-yo Yuki Zairyo (Organic Materials for Imaging)", Bunshin Publishing Co. (1993), pp. 187-192). Examples of compounds suitable for the present embodiment include the following compounds, but are not limited to these.

B(C6F5)4-, PF6-, AsF6-, SbF6-, and CF3SO3-salts of aromatic onium compounds of diazonium, ammonium, iodonium, sulfonium, phosphonium and the like are included. Examples of onium compounds include the compounds described in paragraph (0132) of Japanese Patent Application Laid-Open No. 2005-255821.

Specific compound examples of a sulfonation product that generates sulfonic acid include the compounds described in paragraph (0136) of Japanese Patent Application Laid-Open No. 2005-255821.

Specific compound examples of halides that photogenerate hydrogen halide include the compounds described in paragraph (0138) of Japanese Patent Application Laid-Open No. 2005-255821.

The iron-arene complexes described in paragraph (0140) of Japanese Patent Application Laid-Open No. 2005-255821 are included.

The inkjet ink used in the present embodiment may further include a photopolymerization initiator aid, a sensitizer, a polymerization inhibitor and the like as necessary.

The photopolymerization initiator aid is desirably a tertiary amine compound, and is preferably an aromatic tertiary amine compound. Examples of the aromatic tertiary amine compound include N,N-dimethylaniline, N,N-diethylaniline, N,N-dimethyl-p-toluidine, N,N-dimethylamino-p-benzoic acid ethyl ester, N,N-dimethylamino-p-benzoic acid isoamyl ethyl ester, N,N-dihydroxyethylaniline, triethylamine, and N,N-dimethylhexylamine Among them, N,N-dimethylamino-p-benzoic acid ethyl ester and N,N-dimethylamino-p-benzoic acid isoamyl ether ester are preferred. These compounds may be used singly, or in combination of two or more kinds.

The sensitizer is preferably a compound having ultraviolet spectrum absorption at wavelengths longer than 300 nm, and examples thereof include a polycyclic aromatic compound, a carbazole derivative, a thioxanthone derivative, and an anthracene derivative, all having, as a substituent, at least one of a hydroxyl group, an aralkyloxy group which may be substituted, or an alkoxy group.

Examples of the polymerization inhibitor include (alkyl) phenol, hydroquinone, catechol, resorcin, p-methoxyphenol, t-butylcatechol, t-butylhydroquinone, pyrogallol, 1,1-picrylhydrazyl, phenothiazine, p-benzoquinone, nitrosobenzene, 2,5-di-tert-butyl-p-benzoquinone, dithiobenzoyl disulfide, picric acid, cupferron, aluminum N-nitrosophenylhydroxylamine, tri-p-nitrophenylmethyl, N-(3-oxyanilino-1,3-dimethylbutylidene)aniline oxide, dibutylcresol, cyclohexanone oxime cresol, guaiacol, o-isopropylphenol, butyl aldoxime, methyl ethyl ketoxime, and cyclohexanone oxime.

<Regarding Gelling Agent>

A gel refers to a structure in which a substance has been aggregated by losing independent movement as a result of a lamellar structure, a polymer network formed by non-covalent bonding or hydrogen bonding, a polymer network formed by a physical aggregated state, an interaction of aggregated structures of fine particles and the like, an interaction of precipitated fine crystals, or the like. Gelation means that solidification, semi-solidification, or thickening occurs along with a rapid viscosity increase or elasticity increase. The gelation temperature refers to a temperature at which a solution state with fluidity undergoes a rapid change in viscosity to become a gelled state. This has the same meaning as the terms such as gel transition temperature, gel solution temperature, phase transition temperature, sol-gel phase transition temperature, or gelation point. Solation means a state in which the interaction formed by the gelation described above is resolved, and the solidified state undergoes a change into a liquid state with fluidity. The solation temperature is a temperature at which, when a gelled ink is heated, fluidity occurs in the ink as a result of solation.

Generally, gels are classified into a thermoreversible gel which turns into a solution having fluidity (may also be referred to as a sol) under heating, and returns to the original gel when cooled; and a thermally irreversible gel which, once gelled, does not return to a solution again even by heating. When a gelling agent is used in the present embodiment, it is preferable that the gel formed by the gelling agent be a thermoreversible gel, from the viewpoint of preventing clogging in the head.

When the inkjet ink used in the present embodiment contains a gelling agent, the gelation temperature (sol-gel phase transition temperature) is preferably 40° C. or higher but lower than 120° C., and more preferably from 45° C. or higher and 70° C. or lower. Considering the air temperature in a summer environment, if the phase transition temperature of the ink is 40° C. or higher, stable ejectability of ink droplets that are ejected from an inkjet recording head can be obtained without being affected by the temperature of the printing environment. When the phase transition temperature is lower than 120° C., it is not needed to heat the inkjet recording head to an excessively high temperature, and the burden on the inkjet recording head or the ink supply system can be reduced.

The gelation temperature of the ink is measured using, for example, various rheometers (for example, stress control type rheometer using a cone-plate system, Physica MCR series, manufactured by Anton Paar GmbH). A temperature change curve of the viscosity is obtained, with changing the temperature of a high temperature ink in a sol state being at a low shear rate. Then, the gelation temperature can be determined from the temperature change curve of the viscosity thus obtained. There is also available a method of placing small pieces of iron sealed in a glass tube in a dilatometer, and defining the time point at which the iron pieces no longer fall freely in the ink against the temperature change, as the phase transition point (J. Polym. Sci., 21, 57 (1956)). Further, there is available a method of mounting a cylinder made of aluminum on the ink, and measuring the temperature at which the aluminum cylinder falls freely when the gel temperature is changed, as the gelation temperature (Journal of the Society of Rheology, Japan, Vol. 17, 86 (1989)). As an example of a simple method, a gel-like specimen is placed on a heat plate and heated, and the temperature at which the shape of the specimen is disintegrated is measured, and the temperature can be determined as a gelation temperature. The gelation temperature of the ink can be appropriately regulated by changing the kind of the gelling agent used, the amount of addition of the gelling agent, and the kind of the active ray-curable monomer.

In a case in which the inkjet ink used in the present embodiment contains a gelling agent, the gelling agent may be a high molecular weight compound, or may be a low molecular weight compound. From the viewpoint of the inkjet injectability, a low molecular weight compound is preferred.

Examples of the gelling agent that can be used in the present embodiment will be described below, but the gelling agent is not limited to these compounds.

Examples of high molecular weight compounds that are preferably used in the present embodiment include fatty acid inulins such as inulin stearate; fatty acid dextrins such as dextrin palmitate and dextrin myristate (available as RHEOPEARL series from Chiba Flour Milling Co., Ltd.), glyceryl behenate eicosadioate, and polyglyceryl behenate eicosadioate (available as NOMCORT series from Nisshin Oillio Group, Ltd.).

Examples of low molecular weight compounds that are preferably used in the present embodiment include the low molecular weight oil gelling agents described in Japanese Patent Application Laid-Open No. 2005-126507, Japanese Patent Application Laid-Open No. 2005-255821, and Japanese Patent Application Laid-Open No. 2010-111790;

amide compounds such as N-lauroyl-L-glutamic acid dibutylamide, N-2-ethylhexanoyl-L-glutamic acid dibutylamide (available from Ajinomoto Fine-Techno Co., Inc.);

dibenzylidene sorbitols such as 1,3:2,4-bis-O-benzylidene-D-glusitol (GELOL D available from New Japan Chemical Co., Ltd.);

various waxes such as paraffin wax, microcrystalline wax, petrolactam, candelilla wax, carnauba wax, rice wax, wood wax, jojoba oil, jojoba solid wax, jojoba ester, beeswax, lanolin, whale wax, montan wax, hydrogenated wax, hardened castor oil or hardened castor oil derivatives, montan wax derivatives, paraffin wax derivatives, microcrystalline wax derivatives or polyethylene wax (derivatives), and α-olefin-maleic anhydride copolymer wax (UNILIN series manufactured by Baker-Petrolite Corp.; LUNAC BA manufactured by Kao Corp.; KAOWAX T1 manufactured by Kao Corp.), higher fatty acids such as behenic acid, arachidic acid, stearic acid, palmitic acid, myristic acid, lauric acid, oleic acid, and erucic acid;

higher alcohols such as stearyl alcohol and behenyl alcohol;

hydroxystearic acids such as 12-hydroxystearic acid, 12-hydroxystearic acid derivatives;

fatty acid amides such as lauric acid amide, stearic acid amide, behenic acid amide, oleic acid amide, erucic acid amide, ricinolic acid amide, and 12-hydroxystearic acid amide (for example, NIKKA AMIDE series manufactured by Nippon Kasei Chemical Co., Ltd.; ITOWAX series manufactured by Itoh Oil Chemicals Co., Ltd.; and FATTY-AMID series manufactured by Kao Corp.); N-substituted fatty acid amides such as N-stearyl stearic acid amide and N-oleyl palmitic acid amide; special fatty acid amides such as N,N'-ethylenebisstearylamide, N,N'-ethylenebis-12-hydroxystearylamide, and N,N'-xylenebisstearylamide;

higher amines such as dodecylamine, tetradecylamine and octadecylamine;

fatty acid ester compounds such as stearyl stearate, oleyl palmitate, glycerin fatty acid esters, sorbitan fatty acid esters, propylene glycol fatty acid esters, ethylene glycol fatty acid esters, and polyoxyethylene fatty acid esters (for example, EMALLEX series manufactured by Nihon Emulsion Co., Ltd.; RIKEMAL series manufactured by Riken Vitamin Co., Ltd.; POEM series manufactured by Riken Vitamin Co., Ltd.);

sucrose fatty acid esters such as sucrose stearate and sucrose palmitate (for example, RYOTO SUGAR ESTER series manufactured by Mitsubishi Kagaku Foods Corp.);

dimer acids, and dimer diol (PRIPOR series manufactured by Croda International, PLC). These gelling agents may be used singly, or two or more kinds may be used in mixture.

In a case in which the inkjet ink used in the present embodiment contains a gelling agent, when the inkjet ink is impacted on a recording medium at a temperature lower than the gelation temperature after being ejected from an inkjet recording head, the ink temperature is decreased, and thereby the inkjet ink immediately turns into a gel state. Since the inkjet ink turns into a gel state, mixing and coalescence of dots are suppressed, and the formation of high quality images at high speed printing is enabled. Thereafter, the inkjet ink is cured by irradiation with active radiation, thereby the inkjet ink is fixed to the recording medium, and a firm image film is formed.

The content of the gelling agent contained in the inkjet ink is preferably 1% to 10% by mass, and more preferably 2% to 7% by mass. When the content is 1% by mass or more, gel formation is sufficiently achieved, deterioration of the image quality caused by coalescence of dots can be suppressed, and, in a case in which the inkjet ink is used in a radically cured system, curability caused by oxygen inhibition can be reduced by thickening of ink droplets caused by gel formation. When the content is less than 10% by mass, deterioration of a cured film caused by uncured components after the irradiation of active radiation, and deterioration of inkjet injectability can be reduced.

<Regarding Other Additives>

The inkjet ink used in the present embodiment may contain other arbitrary additives. For example, a surfactant, a leveling additive, a mattifying agent, and a polyester-based resin, a polyurethane-based resin, a vinyl-based resin, an acrylic resin, a rubber-based resin, and waxes for regulating the film properties, can be added. For the purpose of improving storage stability, all known basic compounds can be used. Representative examples therefor include basic organic compounds such as basic alkali metal compounds, basic alkaline earth metal compounds, and amines.

Regarding a basic compound, all known compounds can be used. Examples of the basic compound include basic organic compounds such as basic alkali metal compounds, basic alkaline earth metal compounds, and amines.

Examples of the basic alkali metal compounds include hydroxides of alkali metals (lithium hydroxide, sodium hydroxide, potassium hydroxide, and the like), carbonates of alkali metals (lithium carbonate, sodium carbonate, potassium carbonate, and the like), and alcoholates of alkali metals (sodium methoxide, sodium ethoxide, potassium methoxide, potassium ethoxide, and the like).

Examples of the basic alkaline earth metal compounds include, similarly, hydroxides of alkaline earth metals (magnesium hydroxide, calcium hydroxide, and the like), carbonates of alkali metals (magnesium carbonate, calcium carbonates, and the like), and alcoholates of alkali metals (magnesium methoxide, and the like).

Examples of the basic organic compounds include nitrogen-containing heterocyclic compounds such as amines, quinolines, and quinolidines. Among these, from the viewpoint of the compatibility with photopolymerization monomers, amines are preferred, and examples include octylamine, naphthylamine, xylenediamine, dibenzylamine, diphenylamine, dibutylamine, dioctylamine, dimethylaniline, quinucridine, tributylamine, trioctylamine, tetramethylethylenediamine, tetramethyl-1,6-hexamethylenediamine, hexamethylenetetramine, 2-(methylamino)ethanol, and triethanolamine.

When a basic compound is incorporated, the concentration thereof is preferably in the range of 10 ppm to 50,000 ppm by mass, and particularly preferably in the range of 100 ppm to 5,000 ppm by mass, relative to the total amount of the photopolymerizable monomer. The basic compounds may be used singly, or plural compounds may be used in combination.

<Regarding Sol-Gel Phase Transition Type Inkjet Ink>

When the active ray-curable inkjet ink contains a gelling agent, the inkjet ink undergoes reversible sol-gel phase transition. Since an active ray-curable inkjet ink capable of sol-gel phase transition is a liquid (sol) at a high temperature (for example, about 80° C.), the inkjet ink can be ejected in a sol state from the inkjet recording head. When the active ray-curable inkjet ink is ejected at a high temperature, ink droplets (dots) are impacted on a recording medium, and then are naturally cooled to form a gel. Thereby, coalescence of adjoining dots is suppressed, and the image quality can be increased. The sol-gel phase transition temperature of the inkjet ink used in the present embodiment is preferably 25° C. or higher, and more preferably 40° C. or higher.

The viscosity at 25° C. of the inkjet ink used in the present embodiment is preferably $1.0\times10^3$ to $1.0\times10^6$ mPa·s, and more preferably $1.0\times10^3$ to $1.0\times10^5$ mPa·s. In an ink having an ink viscosity at 25° C. of less than $1.0\times10^3$ mPa·s the viscosity is insufficient to prevent coalescence of ink droplets, and the image quality is deteriorated in the above-mentioned temperature range. In an ink having an ink viscosity at 25° C. of more than $1.0\times10^6$, the viscosity after gelation is too high, and there is a tendency that the viscosity increases to a large extent during a cooling operation. Therefore, in the above-described temperature range, it is difficult to control the viscosity to a level at which appropriate leveling is achieved, and a decrease in glossiness occurs.

The viscosity of the ink can be appropriately regulated by changing the kind of the gelling agent used, the amount of addition of the gelling agent, and the kind of the active ray-curable monomer. The viscosity as used in the present embodiment is a value measured using a stress control type rheometer (Physica MCR series, manufactured by Anton Paar GmbH) that uses a cone-plate system, at a shear rate of 11.7 $s^{-1}$.

Since an inkjet ink containing a gelling agent has a high viscosity, it is difficult to release the gas absorbed by the inkjet ink. However, the inkjet recording method of the present embodiment reduces the amount of gas contained in the ink by performing a heat treatment in the ink tank. Thereby, when printing and recording is carried out using an inkjet ink containing a gelling agent, stabilized injection can be realized even in a case in which air infiltrates into the ink chamber.

2. Inkjet Recording Apparatus

The inkjet recording apparatus used in the present embodiment includes an inkjet recording head having a built-in heater; an ink tank having a built-in heater, with the interior of the tank being in communication with air; and an ink supply channel that communicates between the inkjet recording head and the ink tank. The inkjet recording apparatus further includes a light source for irradiating the ink that has been ejected and impacted to a recording medium with light; and a conveyance belt that moves the recording medium relative to the inkjet recording head, and regulates the temperature.

Hereinafter, the inkjet recording apparatus used in the present embodiment will be described with reference to the drawings. The recording apparatus shown in the drawing is merely a kind of the recording apparatus of the present embodiment, and the present embodiment is not intended to be limited to this drawing.

<First Recording Apparatus>

FIG. 1 is a diagram illustrating an example of the configuration of the essential part of an inkjet recording apparatus, and the inkjet recording apparatus includes ink tank 1, ink supply channel 2, and inkjet recording head 4.

(Ink Tank)

Ink tank 1 includes internal tank heater 17 that heats an inkjet ink; air communicating valve 12 that communicates between the interior and the exterior of ink tank 1; back pressure regulating mechanism 11; stirring apparatus 15; ink supply port 18; and in-tank thermistor 16.

Ink tank 1 is filled in the inside with the inkjet ink from ink supply port 18. Liquid surface 14 of the inkjet ink filled in the inside of ink tank 1 is in contact with air 13, and constitutes a gas-liquid interface.

In the interior of ink tank 1, there is in-tank heater 17 that heats the inkjet ink. There is also in-tank thermistor 16 that detects whether the heating temperature of the inkjet ink is adequate. When the heating temperature is low, the power output of in-tank heater 17 is increased, and thereby the temperature is controlled.

Air-communicating valve 12 that communicates between the interior of ink tank 1 and air, can discharge a gas generated from the heated inkjet ink to the atmosphere.

Ink tank 1 has back pressure regulating mechanism 11 that regulates the back pressure of the interior of ink tank 1. The back pressure refers to a force that pulls in the inkjet ink present at nozzle 44 into the interior of inkjet recording head 4. The back pressure is regulated so as to prevent the inkjet ink from leaking out from nozzle 44, and to form an appropriate meniscus.

Furthermore, the ink tank has stirring apparatus 15 that stirs the inkjet ink inside ink tank 1. Stirring apparatus 15 is desirably, for example, a stirring blade.

(Ink Supply Channel)

Ink supply channel 2 has supply valve 21 and pump 22. When supply valve 21 provided between ink tank 1 and ink supply channel 2 is opened, the inkjet ink inside ink tank 1 is supplied to inkjet recording head 4 through ink supply channel 2. When pump 22 provided at ink supply channel 2 is operated, the inkjet ink inside ink tank 1 can be supplied efficiently to inkjet recording head 4.

It is preferable that the inkjet ink heated at ink tank 1 be cooled by the tube walls of ink supply channel 2 while the inkjet ink passes ink supply channel 2; and more preferably, the temperature of the inkjet ink is lowered by 5° C. to 30° C.

(Inkjet Recording Head)

Inkjet recording head 4 has common flow channel 41; plural nozzles 44 disposed along the direction of the ink flow channel; in-head thermistor 42; and in-head heater 43.

As described above, the inkjet ink is supplied to ink common flow channel 41 of inkjet recording head 4 by passing through ink supply channel 2. The inkjet ink supplied to common flow channel 41 is sent to plural pressure chambers that are not shown in the diagram. The respective pressure chambers are separated apart by barrier walls that are not shown in the diagram, and disposed on each barrier wall is a piezoelectric element which is a piezoelectric material having electrodes. Furthermore, nozzle 44 is disposed in each pressure chamber. Liquid droplets of the inkjet ink are ejected from nozzles 44 of the various pressure chambers due to the movement of the piezoelectric element.

The temperature of the inkjet ink inside inkjet recording head 4 is detected by in-head thermistor 42. When the ink temperature is low, the temperature is controlled by increasing the power output of in-head heater 43.

The conveyance belt 5 that moves the recording medium in a relative manner, has a recording medium mounted thereon, and regulates the temperature of the recording medium to a predetermined temperature. Examples of the means for regulating the temperature of the recording medium include a method of attaching in advance a cooling apparatus and a heating apparatus to conveyance belt 5 that fixes the recording medium, or to a drum for fixing, and regulating the temperature of the recording medium through the back surface; a method of regulating the temperature by blowing cold air or hot air to the recording medium; a method of attaching a cooling medium or a heater at the surface of the position for fixing the recording medium on the apparatus, and regulating the temperature in a non-contact manner; a method of regulating the temperature by irradiating with IR laser or the like; and a method of regulating in advance the temperature of the recording medium before inkjet recording. Among them, for the purpose of making the temperature of the recording medium uniform, a method of regulating the temperature of the recording medium through the back surface is preferred.

Light source 6 is disposed on the downstream side, in the conveyance direction of the recording medium, of inkjet recording head 4 so as to cover the entire width of the recording medium. The liquid droplets that have been ejected by inkjet recording head 4 and impacted on the recording medium is irradiated with light from Light source 6, and thereby the liquid droplets are cured. It is preferable to use an LED as the light source. Regarding the LED as the light source, it is preferable, in order to cure the ink droplets, to install a source of ultraviolet radiation of 370 nm to 410 nm such that the peak illuminance at the image surface will be 0.5 W/cm$^2$ to 10 W/cm$^2$, and more preferably 1 W/cm$^2$ to 5 W/cm$^2$. The amount of light radiated to the image is preferably adjusted to be less than 350 mJ/cm$^2$, in order to prevent radiant heat from being radiated to the ink droplets.

<Second Recording Apparatus>

Figure 2:
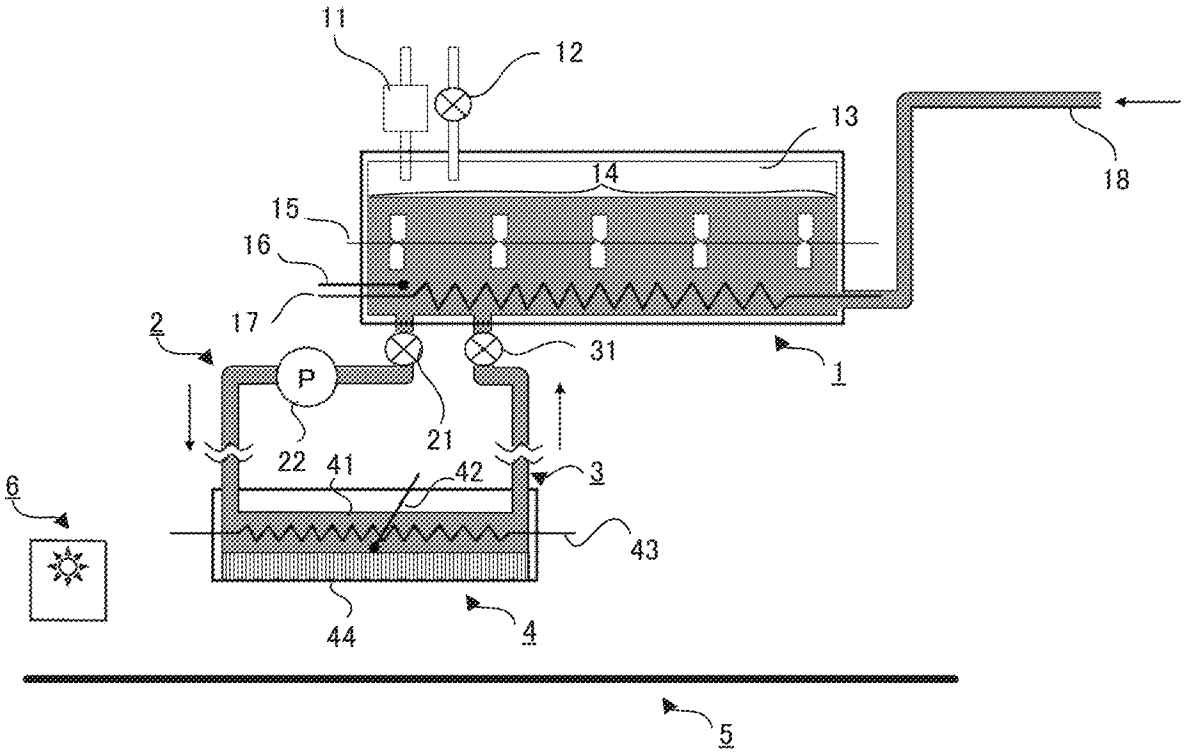
FIG. 2 is a diagram illustrating an example of the configuration of the essential part of an inkjet recording apparatus having a discharge channel.

FIG. 2 is a diagram illustrating an example of the configuration of the essential part of an inkjet recording apparatus, and the inkjet recording apparatus may have the same configuration as that of the inkjet recording apparatus of FIG. 1, except that the inkjet recording apparatus has an ink supply channel that communicates between the inkjet recording head and the ink tank.

(Ink Discharge Channel)

Ink discharge channel 3 has ink discharge valve 31. When discharge valve 31 that is provided at the boundary of ink tank 1 and ink discharge channel 3 is opened, the inkjet ink inside inkjet recording head 4 is discharged to ink tank 1 through ink discharge channel 3.

3. Inkjet Recording Method

The present embodiment is an inkjet recording method using an active ray-curable inkjet ink having an ink viscosity at 25° C. of $1.0\times10^3$ mPa·s to $1.0\times10^6$ mPa·s, the inkjet recording method including at least the following steps (1) to (4), and the method may further include steps (5) and (6).

(1) a step of heating the active ray-curable inkjet ink in the ink tank to A° C.;

(2) a step of supplying the heated active ray-curable inkjet ink to an inkjet recording head;

(3) a step of adjusting the active ray-curable inkjet ink supplied to the inkjet recording head, to temperature B° C. in the range of 70° C. or higher but lower than 120° C., and ejecting the active ray-curable inkjet ink to a recording medium;

(4) a step of irradiating the active ray-curable inkjet ink that has been ejected to the recording medium with active radiation;

(5) a step of discharging the active ray-curable inkjet ink in the inkjet recording head to the ink tank; and (6) a step of stirring the active ray-curable inkjet ink in the ink tank.

<Regarding Step (1)>

The active ray-curable inkjet ink may be the above-described inkjet ink. That is, the active ray-curable inkjet ink may be an active ray-curable inkjet ink having the particular viscosity.

The ink tank is filled with the inkjet ink which is supplied through ink supply port. The ink tank is filled with the inkjet ink in a state in which the interior of the ink tank is in communication with air when the air-communicating valve is opened, and the inkjet ink has a gas-liquid interface. As such, the inkjet ink supplied to the ink tank is not necessarily an ink accommodated in a special package, and the inkjet recording method of the present embodiment can be realized with a simple apparatus.

The inkjet ink is heated to A° C. by the heater inside the ink tank. The ink temperature in the ink tank (A° C.) is preferably higher by 5° C. to 30° C., and more preferably higher by 5° C. to 20° C., than the ink temperature in the ink head (B° C.) that will be described below. When the inkjet ink in the ink tank is heated, the saturated dissolved gas concentration in the ink is decreased. When the saturated dissolved gas concentration is decreased, the gas of the supersaturated amount effervesces, and the gas dissolution concentration in the ink (amount of gas dissolution relative to the amount of ink) is decreased. However, if the ink temperature is too high, deterioration of the ink components may occur. The ink can be heated at a rate of heating of, for example, 0.08° C./s to 0.12° C./s up to the ink temperature (A° C.).

It is preferable that the inkjet ink in the ink tank have the back pressure regulated. The back pressure regulation allows formation of a meniscus in the ink droplets at the tip of the nozzles, and thus ejection of ink droplets can be stabilized. The back pressure is preferably about −22 cmAq to −18 cmAq. It should be noted that, since the temperature change of the ink before and after the application of the back pressure is very small, the influence of the back pressure on the temperature change or the degree of gas dissolution of the ink is very small.

<Regarding Step (2)>

The inkjet ink heated in the temperature range described above is supplied to the inkjet recording head through the ink supply channel. The ink supply channel is a closed system, and the inkjet ink in the ink supply channel cannot be brought into contact with external air. That is, the gas dissolution concentration in the inkjet ink in the ink supply channel is the same as the gas dissolution concentration of the inkjet ink in the ink tank.

Ink supply to the inkjet recording head may be carried out by operating a pump on the ink supply channel.

The inkjet ink is cooled by the tube walls of the ink supply channel while passing through the ink supply channel. If the ink supply channel is too short, the inkjet ink may be cooled by covering the ink supply channel with a cooling medium such as water. When the inkjet ink is cooled, the saturated dissolved gas concentration is increased. On other hand, the gas dissolution concentration itself in the ink does not change. Therefore the "gas dissolution concentration/saturated dissolved gas concentration" of the inkjet ink in the inkjet recording head is lower than the "gas dissolution concentration/saturated dissolved gas concentration" of the inkjet ink in the ink tank.

<Regarding Step (3)>

The inkjet ink cooled at the ink supply channel is supplied to the common flow channel in the inkjet recording head. When the inkjet ink is cooled too much, the temperature is detected by the in-head thermistor, and the power output of the in-head heater is increased, so that the inkjet ink can be heated to the temperature that will be described below.

The ink temperature in the inkjet recording head (B° C.) is preferably in the range of 70° C. or higher but lower than 120° C., and more preferably in the range of 70° C. to 100° C. If the ink temperature is too high, the members of the inkjet recording head may be deteriorated, or the ink components may be deteriorated. If the ink temperature is too low, the ink viscosity cannot be sufficiently lowered, and injectability of the ink droplets is decreased. It is preferable that the ink temperature in the inkjet recording head be lower than the boiling points of the various components of the inkjet ink. Unless particularly stated otherwise, the ink temperature (A° C.) and the ink temperature (B° C.) described above are temperatures at atmospheric pressure (101325 Pa).

The inkjet ink is ejected from various nozzles of the inkjet recording head. At this time, if injection is carried out continuously at a high injection drive frequency, air bubbles may be generated in the ink in the inkjet recording head due to the pressure fluctuation in the inkjet recording head. If air bubbles are generated in the inkjet recording head, the pressure necessary for injection is absorbed by the air bubbles, and there may arise adverse occasions such that liquid droplets may not be injected through the nozzles, or the injection angle may be crooked. In order to prevent the occurrence of this phenomenon, conventionally, an ink that has been degassed in advance is used, or the ink is degassed before use by a degassing membrane that is mounted in the printer. However, since the inkjet ink used in the present embodiment is in a gel form having a very high viscosity at near room temperature, there has been a problem that degassing cannot be achieved in the conventional methods.

Air may enter the pressure chamber through the nozzles while inkjet recording is carried out, which may lead to crooked injection or omitted injection. When omitted injection occurs, a certain amount of the inkjet ink is discharged through the nozzles, and the inkjet ink adhered to the nozzle plate is wiped using a non-woven fabric or a rubber plate, as a head maintenance method to recover omitted injection. It is preferable to recover omitted injection by a single maintenance operation, or with a small amount of ink discharge.

In regard to the inkjet ink used in the present embodiment, the "gas dissolution concentration/saturated dissolved gas concentration" of the inkjet ink in the inkjet recording head is at a reduced level. Therefore, even in a case in which continuous injection is carried out at a high injection frequency, or in which the inkjet ink in the inkjet recording head has absorbed air that has infiltrated through the nozzles, stable injection can be realized. Furthermore, in the maintenance operation described above, nozzle recovery can be carried out securely with a small amount of ink discharge. This is because the ink temperature in the inkjet recording head is set to be lower by 5° C. to 30° C. than the ink temperature in the ink tank.

The amount of liquid droplets per droplet that is ejected from each nozzle of the inkjet recording head may vary with the resolution of the image. The amount of liquid droplet is preferably 1 pl to 10 pl.

The recording medium is not particularly limited, and base materials made of paper, such as ordinary paper used for copying and the like, and art paper; conventional non-coated paper; coated paper having both surfaces of base paper coated with a resin or the like; various pasted paper, synthetic paper, as well as various non-absorbable plastics that are used for so-called soft packaging, and films thereof can be used. Examples of various plastic films include a PET film, an OPS film, an OPP film, an ONY film, a PVC film, a PE film, and a TAC film. Also, metals and glasses are also applicable.

When the inkjet ink used in the present embodiment contains a gelling agent, the surface temperature of the recording medium is lowered by 5° C. to 15° C. than the gelation temperature of the gelling agent, and it is more preferable to lower the surface temperature by 5° C. to 10° C.

The inkjet recording method of the present embodiment exhibits its effects in a so-called shuttle recording mode as well as in a single pass recording mode. More noticeable effects can be obtained with the single pass recording mode which is high speed recording, compared to the image forming mode using the conventional active ray-curable ink.

The conveyance speed of the recording medium in the single pass recording mode is preferably 500 mm/s to 3000 mm/s Faster conveyance speed is preferable, since the faster image formation is realized; however, if the conveyance speed is too fast, the image quality may deteriorate, or curing of the ink may be insufficient.

<Regarding Step (4)>

When active ray the ink droplets that have impacted on a recording medium are irradiated with active ray, the active ray-curable monomer contained in the ink droplets is cross-linked or polymerized, the ink droplets are cured thereby, and an image is formed.

The light to be directed on the ink droplets attached to a recording medium is preferably UV light from an LED light source. Specifically, a water-cooled LED with 395 nm produced by Phoseon Technology can be used. As for the light source of UV light, there can be also a metal halide lamp. However, by employing an LED as a light source, the effect of preventing curing defects on a surface of the curing film of the ink droplets, which are caused by dissolution of the ink droplets by radiation heat from the light source, is obtained.

In order to prevent combining of neighboring ink droplets, the light irradiation for ink droplets is preferably performed within 10 seconds, preferably within 0.001 second to 5 seconds, and more preferably within 0.01 second to 2 seconds after the ink droplets are attached to the recording medium. The light irradiation is preferably performed after discharging the ink droplets from all inkjet recording heads that are accommodated in a head carriage.

<Regarding Step (5)>

In a case in which the inkjet recording apparatus used in the present embodiment has an ink discharge channel, a circulation flow channel can be formed between the inkjet recording head and the ink tank. Thereby, even if gas infiltrates into the inkjet recording head, the saturated dissolved gas concentration can be decreased again in the ink tank, and the gas dissolution concentration can be decreased, and thereby injection stability can be secured. Furthermore, the ink can be circulated at the time of initial introduction of the ink or at the time of the apparatus maintenance.

<Regarding Step (6)>

In a case in which the inkjet recording apparatus used in the present embodiment has a stirring apparatus, the inkjet ink can be caused to flow by stirring the inkjet ink in the ink tank. Examples of the method of causing the ink to flow include a method of causing the inkjet ink to flow by rotating the stirring apparatus. When the inkjet ink in the ink tank is caused to flow, the ink temperature is made uniform.

EXAMPLES

Hereinafter, the present invention will be specifically described by way of Examples, but the embodiments of the present invention are not intended to be limited to these examples.

<Preparation of Radically Polymerizable Ink>

(Preparation of Pigment Dispersion Liquid 1)

Pigment dispersion liquid 1 was prepared by the following procedure. Two kinds of compounds described below were introduced into a stainless steel beaker, and while the beaker was heated on a hot plate at 65° C., the mixture was heated under stirring for one hour to melt.

Pigment dispersant: AJISPER-PB824 (manufactured by Ajinomoto Fine-Techno Co., Inc.) 9 parts by mass Polymerizable compound: APG-200 (tripropylene glycol diacrylate, manufactured by Shin Nakamura Chemical Co., Ltd.) 70 parts by mass Polymerization inhibitor: IRGASTAB UV10 (manufactured by Ciba Japan K.K.) 0.02 parts by mass After the mixture was cooled to room temperature, 21 parts by mass of Pigment Red 122 (manufactured by Dainichiseika Color Chemicals Manufacturing Co., Ltd., CHROMOFINE RED 6112JC) was added thereto as a pigment. Then, the mixture was introduced into a glass bottle together with 200 g of zirconia beads having a diameter of 0.5 mm, the bottle was tightly sealed, and the mixture was subjected to a dispersion treatment for 8 hours in a paint shaker. Thereafter, the zirconia beads were removed, and thus pigment dispersion liquid 1 was prepared.

(Preparation of Ink 1)

According to the ink composition described below, each component and pigment dispersion liquid 1 were mixed in their respective parts by mass, and the mixture was heated to 100° C. and then stirred. A solution thus obtained was filtered through a metal mesh filter of #3000 under heating, and was cooled. Thus, ink 1 was prepared.

[Gelling Agent]

FATTY AMID T (manufactured by Kao Corp.) 5.0 parts by mass

[Polymerizable Compound]

NK ESTER A-400 (polyethylene glycol diacrylate, manufactured by Shin Nakamura Chemical Co., Ltd.) 29.8 parts by mass SR494 (4EO-modified pentaerythritol tetraacrylate, manufactured by Sartomer USA, LLC) 15.0 parts by mass SR499 (6EO-modified trimethylolpropane triacrylate, manufactured by Sartomer USA, LLC) 20.0 parts by mass

[Photopolymerization Initiator]

TPO (phosphine oxide, DAROCURE TPO, manufactured by Ciba Japan K.K.) 6.0 parts by mass

[Initiator Aid]

ITX (isopropylthioxanthone, SPEEDCURE ITX, manufactured by Lambson, Ltd.) 1.0 part by mass EDB (amine aid, SPEEDCURE EDB, manufactured by Lambson, Ltd.) 1.0 part by mass

[Polymerization Inhibitor]

IRGASTAB UV10 (manufactured by Ciba Japan K.K.) 1.0 parts by mass

[Surfactant]

KF-352 (polyether-modified silicone, manufactured by Shin-Etsu Chemical Co., Ltd.) 0.05 parts by mass

[Pigment Dispersion Liquid]

Pigment dispersion liquid 1 19.0 parts by mass

<Preparation of Cationically Polymerizable Ink>

(Preparation of Pigment Dispersion Liquid 2)

Pigment dispersion liquid 2 was prepared by the following procedure. Two kinds of compounds described below were introduced into a stainless steel beaker, and while the beaker was heated on a hot plate at 65° C., the mixture was heated under stirring for one hour to melt.

Pigment dispersant: AJISPER-PB824 (manufactured by Ajinomoto Fine-Techno Co., Inc.) 9 parts by mass Polymerizable compound: OXT221 (oxetane compound, manufactured by Toagosei Co., Ltd.) 70 parts by mass The subsequent procedure was carried out in the same manner as in the preparation of pigment dispersion liquid 1, and thus pigment dispersion liquid 2 was prepared.

(Preparation of Ink 2)

According to the ink composition described below, each component and pigment dispersion liquid 2 were mixed in their respective parts by mass, and the mixture was heated to 100° C. and then stirred. A solution thus obtained was filtered through a metal mesh filter of #3000 under heating, and was cooled. Thus, ink 2 was prepared.

[Gelling Agent]

KAOWAX T1 (manufactured by Kao Corp.) 1.8 parts by mass

[Polymerizable Compound]

OXT221 (oxetane compound, manufactured by Toagosei Co., Ltd.) 42.1 parts by mass CELLOXIDE 2021P (alicyclic epoxy, manufactured by Daicel Corp.) 30.0 parts by mass

[Photopolymerization Initiator]

CPI-100P (50% solution of triallylsulfonium salt in propylene carbonate, manufactured by San-Apro, Ltd.) 5.0 parts by mass

[Sensitizer]

DEA (diethoxyanthracene, manufactured by Kawasaki Kasei Chemicals Ltd.) 2.0 parts by mass

[Surfactant]

X22-4272 (manufactured by Shin-Etsu Chemical Co., Ltd.) 0.05 parts by mass

[Pigment Dispersion Liquid]

Pigment dispersion liquid 2 19.0 parts by mass

<Measurement of Ink Properties>

For ink 1 and ink 2 prepared by the method described above, the gelation temperature and the ink viscosity were measured by the following methods.

A prepared ink was mounted in a stress control type rheometer (Physica MCR300, manufactured by Anton Paar GmbH) capable of controlling temperature, the ink was heated to 100° C., and then the ink was cooled to 25° C. at a temperature decrease rate of 0.1° C./s. Then, viscosity measurement was carried out at a shear rate of 11.7 $s^{-1}$. Measurement was carried out using a cone-plate system (CP75-1, manufactured by Anton Paar GmbH) having a diameter of 75 mm and a cone angle of 10. Temperature control was carried out by a Peltier element type temperature control apparatus (TEK150P/MC1) attached to Physica MCR300. From a viscosity curve obtained by the measurement, the temperature at which the viscosity rapidly increased was read, and the temperature at which the viscosity reached 500 mPa·s was defined as the gelation temperature. Similarly, the temperature of the ink was adjusted to 25° C. Thereafter, the ink was heated to 100° C. at a heating temperature of 0.1° C./s, and viscosity measurement was carried out at a shear rate of 11.7 $s^{-1}$. From a viscosity curve obtained by the measurement, the temperature at which the viscosity rapidly decreased was read, and the temperature at which the viscosity reached 500 mPa·s was defined as the solation temperature.

The gelation temperatures and solation temperatures of ink 1 and ink 2 are presented in Table 1.

TABLE 1

| Ink | | Ink 1 | Ink 2 |
|---|---|---|---|
| Viscosity at 25° C. | mPa · s | $9.8 \times 10^3$ | $1.7 \times 10^3$ |
| Gelation temperature | ° C. | 51 | 53 |
| Solation temperature | ° C. | 66 | 68 |

Example 1

An ink tank and an inkjet recording head were connected in the configuration shown in FIG. 1, and an evaluation on bubble discharge and an evaluation on continuous injection were carried out.

The ink temperatures in the ink tank were adjusted to be the temperature indicated in Table 2. The ink temperature in the ink tank was adjusted by heating the ink using the heater provided in the ink tank. The ink temperature inside the ink tank was detected by a thermistor, and was controlled by adjusting the power output of the heater. The experiment was initiated using an ink tank having an internal volume of 200 $cm^3$, which was filled with 150 $cm^3$ of an inkjet ink.

A stirring apparatus was provided inside the ink tank. In the case of performing stirring, the evaluation of continuous injection was carried out while the inkjet ink inside the ink tank was weakly stirred.

For the inkjet recording head, a piezo head having 512 nozzles, each nozzle having a nozzle diameter of 24 μm, was used. The inkjet inks were heated such that the ink temperatures in the inkjet recording head reached the temperatures indicated in Table 2. The ink temperatures in the inkjet recording head were adjusted by heating the ink using the heater provided in the inkjet recording head. The ink temperatures inside the inkjet recording head were detected by a thermistor, and were controlled by adjusting the power output of the heater. The volume in the inkjet recording head was about 1 $cm^3$, and the volume of the ink supply channel connecting the inkjet recording head and the ink tank was about 3 $cm^3$.

The air-communicating valve of the ink tank was opened until the inkjet ink in the ink tank and the inkjet ink in the inkjet recording head respectively reached the set temperatures. After the ink temperatures reached the respective set temperatures, the air-communicating valve was closed. Then, the inks were allowed to stand for 5 minutes while the back pressure was maintained at −20 cmAq by means of a back pressure adjusting mechanism.

Thereafter, the back pressure was instantaneously adjusted to −60 cmAq, and thereby the ink meniscus formed at the nozzle was broken. Thereby, air was allowed to infiltrate into the nozzle through the nozzle surface, and thus a state of omitted injection caused by air entrapment was achieved.

(Recovery Operation)

Next, for the purpose of recovery from omitted injection, a pump on the ink flow channel that connected the ink tank and the inkjet recording head was operated, and thus about 5 cc of the inkjet ink was extruded from the inkjet recording head. Subsequently, the inkjet ink remaining on the nozzle surface was wiped with a non-woven fabric.

(Evaluation of Bubble Discharge)

After it was confirmed that the back pressure was −20 cmAq, the drive voltage waveform of the inkjet recording head was adjusted. Injection was carried out at a liquid droplet amount of 3.5 pl, a liquid droplet speed of 6 msec, and an injection frequency of 25 kHz, and the number of nozzles that did not perform injection was counted as the number of nozzles with omitted injection.

(Evaluation of Continuous Injection)

Extrusion of the ink and wiping of the ink remaining on the nozzle surface was repeated, and thus a state in which every nozzle was capable of injection was achieved. Next, it was confirmed that the back pressure was −20 cmAq, and 30 consecutive nozzles among the 512 nozzles were continuously driven at a liquid droplet amount of 3.5 pl, a liquid droplet speed of 6 msec, and an injection frequency of 25 kHz. After 1 minute, after 5 minutes, and after 10 minutes from the initiation of driving, the number of nozzles that did not perform injection was counted as the number of nozzles with omitted injection. In a case in which there were nozzles with omitted injection at the time of initiation of injection, the recovery operation was carried out again, and only after injection from 30 consecutive nozzles was confirmed, the experiment was initiated.

The evaluation results thus obtained are presented in Table 2.

was initiated using an ink tank having an internal volume of 200 $cm^3$, which was filled with 150 $cm^3$ of an inkjet ink.

A stirring apparatus was provided inside the ink tank. In the case of performing stirring, the evaluation of continuous injection was carried out while the inkjet ink inside the ink tank was weakly stirred.

For the inkjet recording head, a piezo head having 512 nozzles, each nozzle having a nozzle diameter of 24 μm, was used. The inkjet inks were heated such that the ink temperatures in the inkjet recording head reached the temperatures indicated in Table 3. The ink temperatures in the inkjet recording head were adjusted by heating the ink using the heater provided in the inkjet recording head. The ink temperatures inside the inkjet recording head were detected by a thermistor, and were controlled by adjusting the power output of the heater. The volume in the inkjet recording head was about 1 $cm^3$, and the volume of the ink supply channel connecting the inkjet recording head and the ink tank was about 6 $cm^3$.

The air-communicating valve of the ink tank was opened until the inkjet ink in the ink tank and the inkjet ink in the inkjet recording head respectively reached the set temperatures. After the ink temperatures reached the respective set temperatures, the air-communicating valve was closed. Then, the inks were allowed to stand for 5 minutes while the back pressure was maintained at −20 cmAq by means of a back pressure adjusting mechanism.

Thereafter, the back pressure was instantaneously adjusted to −60 cmAq, and thereby the ink meniscus formed at the nozzle was broken. Thereby, air was allowed to infiltrate into the nozzle through the nozzle surface, a state of omitted injection caused by air entrapment was achieved,

TABLE 2

| | | | Comparative Example 1-1 | Comparative Example 1-2 | Example 1-1 | Example 1-2 | Example 1-3 | Example 1-4 | Comparative Example 1-3 |
|---|---|---|---|---|---|---|---|---|---|
| Ink No. | | | Ink 1 | Ink 1 | Ink 1 | Ink 1 | Ink 1 | Ink 1 | Ink 1 |
| Circulation flow channel between ink tank-inkjet recording head | | | | | No circulation flow channel (FIG. 1) | | | | |
| Ink temperature | Inside ink tank | Thermistor 1 (T1) | 25 | 75 | 82 | 83 | 95 | 95 | 135 |
| | Inside inkjet recording head | Thermistor 2 (T2) | 75 | 76 | 75 | 76 | 76 | 85 | 120 |
| Temperature difference | | ΔT (T1 − T2) | −50 | −1 | 7 | 7 | 19 | 10 | 15 |
| Stirring in ink tank | | | Present | Present | Present | None | Present | Present | Present |
| Evaluation of bubble discharge | | Number of nozzles with omitted injection | 87 | 54 | 0 | 4 | 0 | 0 | 512 |
| Evaluation of continuous injection | After 1 minute of continuous injection | Number of nozzles with omitted injection | 25 | 10 | 0 | 0 | 0 | 0 | ×:Not injectable |
| | After 5 minutes of continuous injection | Number of nozzles with omitted injection | 30 | 22 | 0 | 1 | 1 | 0 | |
| | After 10 minutes of continuous injection | Number of nozzles with omitted injection | 30 | 30 | 1 | 5 | 3 | 2 | |

Example 2

An ink tank and an inkjet recording head were connected in the configuration shown in FIG. 2, and an evaluation on bubble discharge and an evaluation on continuous injection were carried out.

The ink temperatures in the ink tank were adjusted to be the temperatures indicated in Table 3. The ink temperature in the ink tank was adjusted by heating the ink using the heater provided in the ink tank. The ink temperature inside the ink tank was detected by a thermistor, and was controlled by adjusting the power output of the heater. The experiment and the degree of gas dissolution of the inkjet ink in the inkjet recording head was raised.

(Recovery Operation)

After valve 2 was opened, the pump on the ink flow channel that connected the ink tank and the inkjet recording head was operated at a flow rate of 100 $cm^3$/min, and the ink was circulated for one minute. Thereafter, the pump was stopped, and valve 2 was closed. Subsequently, the pump on the ink flow channel that connected the ink tank and the inkjet recording head was operated while valve 2 was closed, and about 5 cc of the ink was extruded from the inkjet recording head. Thereafter, the ink remaining on the nozzle surface was wiped with a non-woven fabric.

(Evaluation)

After it was confirmed that the back pressure was −20 cmAq, the drive voltage waveform of the inkjet recording head was adjusted. Injection was carried out at a liquid droplet amount of 3.5 pl, a liquid droplet speed of 6 msec, and an injection frequency of 25 kHz, and the number of nozzles that did not perform injection was counted as the number of nozzles with omitted injection.

(Evaluation of Continuous Injection)

Extrusion of the ink and wiping of the ink remaining on the nozzle surface was repeated, and thus a state in which every nozzle was capable of injection was achieved. Next, it was confirmed that the back pressure was −20 cmAq, and 30 consecutive nozzles among the 512 nozzles were continuously driven at a liquid droplet amount of 3.5 pl, a liquid droplet speed of 6 msec, and an injection frequency of 25 kHz. After 1 minute, after 5 minutes, and after 10 minutes from the initiation of driving, the number of nozzles that did not perform injection was counted as the number of nozzles with omitted injection. In a case in which there were nozzles with omitted injection at the time of initiation of injection, the recovery operation was carried out again, and only after injection from 30 consecutive nozzles was confirmed, the experiment was initiated.

The evaluation results thus obtained are presented in Table 3.

TABLE 3

| | | | Comparative Example 2-1 | Example 2-1 | Example 2-2 | Example 2-3 | Example 2-4 | Comparative Example 2-2 | Example 2-5 | Example 2-6 | Comparative Example 2-7 |
|---|---|---|---|---|---|---|---|---|---|---|---|
| Ink No. | | | Ink 1 | Ink 1 | Ink 1 | Ink 1 | Ink 1 | Ink 2 | Ink 2 | Ink 2 | Ink 2 |
| Circulation flow channel between ink tank-inkjet recording head | | | Circulation flow channel present (FIG. 2) | | | | | | | | |
| Ink temperature | Inside ink tank | Thermistor 1 (T1) | 75 | 82 | 83 | 90 | 95 | 76 | 83 | 91 | 98 |
| | Inside inkjet recording head | Thermistor 2 (T2) | 75 | 75 | 76 | 80 | 84 | 75 | 75 | 82 | 88 |
| Temperature difference | | ΔT (T1 − T2) | 0 | 7 | 7 | 10 | 11 | 1 | 8 | 9 | 10 |
| Stirring in ink tank | | | Present | Present | None | Present | Present | Present | Present | Present | Present |
| Evaluation of bubble discharge | | Number of nozzles with omitted injection | 36 | 0 | 2 | 0 | 0 | 41 | 0 | 0 | 0 |
| Evaluation of continuous injection | After 1 minute of continuous injection | Number of nozzles with omitted injection | 8 | 0 | 0 | 0 | 0 | 7 | 0 | 0 | 0 |
| | After 5 minutes of continuous injection | Number of nozzles with omitted injection | 20 | 0 | 1 | 0 | 1 | 22 | 0 | 0 | 2 |
| | After 10 minutes of continuous injection | Number of nozzles with omitted injection | 30 | 0 | 5 | 0 | 2 | 30 | 0 | 1 | 3 |

Example 3

An ink tank and an inkjet recording head were connected in the configuration shown in FIG. 2, and an evaluation on bubble discharge and an evaluation on continuous injection were carried out.

The experiment was carried out under the same conditions as in Example 2, except that a piezo head having 256 nozzles, each nozzle having a nozzle diameter of 28 μm, was used, and injection was carried out at a liquid droplet amount of 12 pl, a liquid droplet speed of 5 msec, and an injection frequency of 18 kHz.

The results thus obtained are presented in Table 4.

TABLE 4

| | | | Comparative Example 3-1 | Example 3-1 | Example 3-2 | Example 3-3 | Example 3-4 | Comparative Example 3-2 | Example 3-5 | Example 3-6 | Comparative Example 3-7 |
|---|---|---|---|---|---|---|---|---|---|---|---|
| Ink No. | | | Ink 1 | Ink 1 | Ink 1 | Ink 1 | Ink 1 | Ink 2 | Ink 2 | Ink 2 | Ink 2 |
| Circulation flow channel between ink tank-inkjet recording head | | | Circulation flow channel present (FIG. 2) | | | | | | | | |
| Ink temperature | Inside ink tank | Thermistor 1 (T1) | 75 | 82 | 84 | 90 | 95 | 76 | 83 | 91 | 98 |
| | Inside inkjet recording head | Thermistor 2 (T2) | 75 | 75 | 76 | 79 | 83 | 75 | 76 | 82 | 88 |
| Temperature difference | | ΔT (T1 − T2) | 0 | 7 | 8 | 11 | 12 | 1 | 7 | 9 | 10 |
| Stirring in ink tank | | | Present | Present | None | Present | Present | Present | Present | Present | Present |
| Evaluation of bubble discharge | | Number of nozzles with omitted injection | 25 | 0 | 2 | 0 | 0 | 27 | 0 | 0 | 0 |
| Evaluation of continuous injection | After 1 minute of continuous injection | Number of nozzles with omitted injection | 7 | 0 | 0 | 0 | 0 | 5 | 0 | 0 | 0 |
| | After 5 minutes of continuous injection | Number of nozzles with omitted injection | 17 | 0 | 1 | 0 | 0 | 15 | 0 | 0 | 1 |
| | After 10 minutes of continuous injection | Number of nozzles with omitted injection | 30 | 0 | 4 | 0 | 1 | 30 | 0 | 1 | 3 |

From the results of Tables 2 to 4, when the difference (T1−T2) between the ink temperature in the ink tank (T1) and the ink temperature in the inkjet recording head (T2) is less than 5° C., both bubble dischargeability and continuous injectability decrease (for example, Comparative Example 2-1 and Comparative Example 3-1).

Even in a case in which the difference (T1−T2) between the ink temperature in the ink tank (T1) and the ink temperature in the inkjet recording head (T2) is in the range of 5° C. to 30° C., if the ink temperature in the inkjet recording head (T2) is 120° C. or higher, bubble dischargeability decreases, and continuous injection cannot be carried out (Comparative Example 1-3). One possible cause of this is that when the ink temperature in the inkjet recording head is set to a high temperature (120° C. or higher), the components contained in the ink undergo boiling.

It can be seen that when the ink temperature in the inkjet recording head (T2) is set to 70° C. or higher but lower than 120° C., and the difference (T1−T2) between the ink temperature in the ink tank (T1) and the ink temperature in the inkjet recording head (T2) is set in the range of 5° C. to 30° C., bubble dischargeability and continuous injectability are enhanced.

Even if the difference between the ink temperature in the ink tank and the ink temperature in the inkjet recording head is the same, when the inside of the ink tank is stirred, bubble dischargeability and continuous injectability are enhanced (for example, Example 1-1 and Example 1-2). Even if the difference between the ink temperature in the ink tank and the temperature in the inkjet recording head is the same, when there is available a circulation flow channel, bubble dischargeability and continuous injectability are further enhanced (for example, Example 1-1 and Example 2-1).

The present application claims priority of a preceding Japanese patent application filed by the same applicant, that is, Japanese Patent Application No. 2012-045488 (filing date: Mar. 1, 2012), the disclosure of which is incorporated herein as a part by reference.

INDUSTRIAL APPLICABILITY

According to the inkjet recording method of the present invention, when recording is performed using an active ray-curable inkjet ink, particularly an active ray-curable inkjet ink containing a gelling agent, the influence exerted on injection by the gas incorporated into the inkjet ink at the time of initial introduction of the ink, or by the gas infiltrating into the ink chamber of an inkjet recording head at the time of head cleaning, is reduced. Furthermore, a highly reliable inkjet recording method can be supplied by preventing omitted injection or crooked flight at the time of continuous injection.

REFERENCE SIGNS LIST

1 Ink tank
11 Back pressure adjusting mechanism
12 Air-communicating valve
13 Air
14 Inkjet ink liquid surface
15 Stirring apparatus
16 In-tank thermistor
17 In-tank heater
18 Ink supply port
2 Ink supply channel
21 Supply valve
22 Pump
3 Ink discharge channel
31 Discharge valve
4 Inkjet recording head
41 Common flow channel
42 In-head thermistor
43 In-head heater
44 Nozzle
5 Conveyance belt
6 Light source

The invention claimed is:

1. An inkjet recording method comprising a step of ejecting an active ray-curable inkjet ink having an ink viscosity at 25° C. of $1.0\times10^3$ to $1.0\times10^6$ mPa·s, using an inkjet recording apparatus including:

an inkjet recording head having a built-in heater;

an ink tank having a built-in heater and an air-communicating valve, wherein the air-communicating valve communicates air to the interior of the tank when the valve is opened; and an ink supply channel that communicates between the inkjet recording head and the ink tank, the method further comprising:

heating the active ray-curable inkjet ink in the ink tank to A° C. for degassing the ink while the air-communicating valve is open, whereby a gas generated by the ink during the step of heating can be discharged through the air-communicating valve;

supplying the active ray-curable inkjet ink that has been heated to A° C., to the inkjet recording head through the ink supply channel;

adjusting the active ray-curable inkjet ink that has been supplied to the inkjet recording head, to temperature B° C. in the range of 70° C. or higher but lower than 120° C., and ejecting the ink to a recording medium; and irradiating the active ray-curable inkjet ink that is ejected to the recording medium, with active radiation, wherein A° C. is a temperature higher by 5° C. to 30° C. than B° C.

2. The inkjet recording method according to claim 1, wherein the active ray-curable inkjet ink comprises a gelling agent.

3. The inkjet recording method according to claim 1, wherein the sol-gel phase transition temperature for the active ray-curable inkjet ink is 25° C. or higher.

4. The inkjet recording method according to claim 1, further comprising discharging the active ray-curable inkjet ink in the inkjet recording head to the ink tank.

5. The inkjet recording method according to claim 1, further comprising stirring the active ray-curable inkjet ink in the ink tank.

6. The inkjet recording method according to claim 1, wherein the active ray-curable inkjet ink comprises a radically polymerizable compound.

7. The inkjet recording method according to claim 1, wherein the active ray-curable inkjet ink comprises a bifunctional monomer or polyfunctional monomer.

8. The inkjet recording method according to claim 1, wherein the active ray-curable inkjet ink comprises a dispersant selected from the group consisting of hydroxyl group-containing carboxylic acid esters, salts of long-chain polyaminoamides and high molecular weight acid ester, salts of high molecular weight polycarboxylic acid, salts of long-chain polyaminoamide and polar acid esters, high molecular weight unsaturated acid esters, copolymerization products, modified polyurethanes, modified polyacrylates, polyether ester type anionic active agents, naphthalenesulfonic acid-formalin condensate salts, aromatic sulfonic acid-formalin condensate salts, polyoxyethylene alkyl phosphoric acid esters, polyoxyethylene nonyl phenyl ethers, stearylamine acetates, and pigment derivatives.

9. The inkjet recording method according to claim 1, wherein the active ray-curable inkjet ink comprises a pigment having an average particle size of not less than 0.08 μm and not more than 0.5 μm.

10. The inkjet recording method according to claim 1, wherein a surface temperature of the recording medium is lowered by 5° C. to 15° C. than the gelation temperature of the gelling agent.

11. The inkjet recording method according to claim 1, wherein the ink tank has a back pressure wherein the back pressure is −22 cmAq to −18 cmAq.

12. The inkjet recording method according to claim 1, further comprising the step of closing the air-communication valve after the ink temperature reaches A° C. during the step of heating.

13. The inkjet recording method according to claim 12, wherein a back pressure in the ink tank is maintained by a back pressure regulating mechanism connected to an interior of the ink tank after the air-communication valve is closed.

* * * * *